US010105591B2

(12) United States Patent
Mercer et al.

(10) Patent No.: US 10,105,591 B2
(45) Date of Patent: Oct. 23, 2018

(54) ROULETTE BALL LAUNCHING SYSTEM

(71) Applicant: BALLY GAMING, INC., Las Vegas, NV (US)

(72) Inventors: Haven A. Mercer, Excelsior, MN (US); Troy D. Nelson, Big Lake, MN (US); James P. Helgesen, Eden Prairie, MN (US); Paul K. Scheper, Bloomington, MN (US); Jamal Hani Kotifani, Eden Prairie, MN (US); Georg Fekete, Korneuburg (AT)

(73) Assignee: Bally Gaming, Inc., Las Vegas, NV (US)

( * ) Notice: Subject to any disclaimer, the term of this patent is extended or adjusted under 35 U.S.C. 154(b) by 0 days.

(21) Appl. No.: 14/865,592

(22) Filed: Sep. 25, 2015

(65) Prior Publication Data

US 2017/0087446 A1 Mar. 30, 2017

(51) Int. Cl.

| | |
|---|---|
| ***A63F 1/18*** | (2006.01) |
| ***A63F 5/00*** | (2006.01) |
| ***A63F 7/24*** | (2006.01) |
| ***A63F 7/26*** | (2006.01) |
| ***A63F 7/34*** | (2006.01) |

(52) U.S. Cl.

CPC ..... *A63F 5/00* (2013.01); *A63F 5/0005* (2013.01); *A63F 5/007* (2013.01); *A63F 7/2409* (2013.01); *A63F 7/26* (2013.01); *A63F 7/34* (2013.01); *A63F 2007/343* (2013.01); *A63F 2007/345* (2013.01)

(58) Field of Classification Search

CPC ... A63F 5/00; A63F 5/02; A63F 5/007; G03B 21/00; G07F 17/32; A63B 69/40

USPC ..... 273/142 E, 143 R, 142 A, 142 D, 142 G, 273/148 R; 124/14, 16

See application file for complete search history.

(56) References Cited

U.S. PATENT DOCUMENTS

| | | | | |
|---|---|---|---|---|
| 1,527,876 A * | 2/1925 | Janik | A63F 7/06 | 273/108.1 |
| 1,537,236 A * | 5/1925 | Jarvis | A63F 5/0088 | 273/119 R |
| 2,104,740 A | 1/1938 | Evans | | |
| 2,490,802 A * | 12/1949 | Hanff, Jr. | A63D 3/02 | 124/4 |
| 3,084,680 A * | 4/1963 | Goldfarb | A63B 69/408 | 124/16 |
| 3,142,292 A * | 7/1964 | Suchland | A63D 3/02 | 124/41.1 |

(Continued)

FOREIGN PATENT DOCUMENTS

| | | |
|---|---|---|
| EP | 0160157 A2 | 11/1985 |
| ES | 1077627 U | 8/2012 |

(Continued)

OTHER PUBLICATIONS

International Search Report from PCT International Application No. PCT/US2016/053505, (completed Nov. 30, 2016), 4 pages.

(Continued)

*Primary Examiner* — Melba Bumgarner
*Assistant Examiner* — Joseph B Baldori
(74) *Attorney, Agent, or Firm* — TraskBritt

(57) ABSTRACT

Disclosed are an apparatus, a system, and method for automatically launching roulette balls into a ball track of a roulette wheel.

20 Claims, 17 Drawing Sheets

(56) References Cited

U.S. PATENT DOCUMENTS 3,364,787 A * 1/1968 Miller ..... A63D 5/02 473/107
3,511,225 A * 5/1970 Yokoi ..... A63B 69/408 124/36
3,610,223 A * 10/1971 Green ..... A63B 69/408 124/16
3,853,324 A * 12/1974 Reiner ..... A63F 3/06 273/119 A
3,870,307 A 3/1975 Meyer et al.
4,010,953 A 3/1977 Russo
4,262,648 A * 4/1981 Wegener ..... A63B 69/408 124/32
4,337,945 A 7/1982 Levy
4,471,746 A * 9/1984 Ando ..... A63B 69/40 124/41.1
4,643,425 A 2/1987 Herzenberger
4,735,416 A 4/1988 McNally
4,754,980 A 7/1988 Torgow
4,869,505 A 9/1989 Manabe
5,042,810 A 8/1991 Williams
5,048,832 A * 9/1991 Kaminkow ..... A63F 7/3075 273/119 A
5,261,851 A 11/1993 Siebert
5,326,103 A 7/1994 Lund et al.
5,415,150 A * 5/1995 Dallas ..... A63B 69/407 124/16
5,501,457 A 3/1996 Ogihara
5,588,650 A 12/1996 Eman
5,636,838 A 6/1997 Caro
5,687,967 A 11/1997 Klaus
5,718,431 A 2/1998 Ornstein
5,743,798 A 4/1998 Adams et al.
5,743,800 A 4/1998 Huard et al.
5,836,583 A 11/1998 Towers
5,857,451 A * 1/1999 Ciluffo ..... A63B 69/0026 124/6
5,975,527 A * 11/1999 Winchester ..... A63B 69/408 124/36
5,980,399 A * 11/1999 Campbell ..... A63B 69/409 124/61
6,019,095 A * 2/2000 Sommer ..... A63D 3/02 124/4
6,059,659 A 5/2000 Busch et al.
6,083,105 A 7/2000 Ronin
6,089,215 A * 7/2000 Morris ..... A63B 69/408 124/16
6,099,417 A * 8/2000 Brown ..... A63B 69/0075 473/417
6,159,112 A * 12/2000 Ciluffo ..... A63B 69/0024 124/4
6,379,257 B1 * 4/2002 Skleba ..... A63B 47/008 273/129 V
6,520,854 B1 2/2003 McNally
6,616,530 B2 9/2003 Pearce et al.
6,659,866 B2 12/2003 Frost et al.
6,755,741 B1 6/2004 Rafaeli
7,383,832 B2 * 6/2008 Soberg ..... A63B 69/0002 124/6
7,661,676 B2 2/2010 Smith et al.
7,669,853 B2 3/2010 Jones
7,674,172 B2 3/2010 Miltenburger
7,806,788 B1 * 10/2010 Neuman ..... A63B 69/408 124/4
7,815,187 B2 10/2010 Yokota
7,841,597 B2 11/2010 Cammegh
7,901,285 B2 3/2011 Tran et al.
7,926,810 B2 4/2011 Fisher et al.
7,934,980 B2 5/2011 Blaha et al.
7,988,548 B2 8/2011 Okada
8,028,993 B2 10/2011 Witty
8,152,170 B2 4/2012 Yokota
D663,785 S 7/2012 Walsh et al.
8,272,958 B2 9/2012 Smith et al.
8,282,100 B2 10/2012 Kido
8,286,619 B2 * 10/2012 Mihaljevic ..... A63B 69/408 124/16
8,381,709 B2 * 2/2013 Woessner ..... A63B 69/40 124/16
8,439,360 B2 5/2013 Kido
8,511,682 B2 8/2013 Yokota
8,517,382 B1 8/2013 Pagliuca
8,899,586 B2 12/2014 Shelburn
9,067,119 B1 * 6/2015 Vaught ..... F41B 3/03
9,259,631 B2 * 2/2016 Gowan ..... A63B 69/408
9,266,014 B2 * 2/2016 Dayal ..... A63F 7/0664
9,452,340 B2 * 9/2016 Vaught ..... F41B 3/03
2003/0060263 A1 3/2003 Pearce et al.
2005/0020347 A1 1/2005 Moshal
2005/0164759 A1 7/2005 Smith et al.
2005/0164762 A1 7/2005 Smith et al.
2005/0192076 A1 9/2005 Lowery
2008/0139079 A1 6/2008 Siebert
2008/0242184 A1 10/2008 Divnick
2010/0120487 A1 5/2010 Walker et al.
2011/0214652 A1 * 9/2011 Woessner ..... A63B 69/40 124/6
2013/0053117 A1 2/2013 Snow
2013/0059638 A1 3/2013 Nicely
2013/0184059 A1 7/2013 Costello et al.
2013/0184079 A1 7/2013 Costello et al.
2013/0214486 A1 8/2013 Shelburn et al.
2014/0094244 A1 4/2014 Baron et al.
2014/0345585 A1 11/2014 Gontarski
2014/0370980 A1 12/2014 Czyzewski et al.
2015/0157927 A1 6/2015 Shelbum et al.
2016/0250536 A1 * 9/2016 Hart ..... A63B 69/40 124/7

FOREIGN PATENT DOCUMENTS

ES 1087979 U 8/2013
FR 2775910 A1 9/1999
JP 2015029801 A 2/2015
TW 201023954 A 7/2010
WO 2008153505 A2 12/2008
WO 2010141736 A1 12/2010
WO 2014188025 A1 11/2014
WO 2014189936 A1 11/2014

OTHER PUBLICATIONS

International Written Opinion from PCT International Application No. PCT/US2016/053505, (dated Dec. 12, 2016), 6 pages.

* cited by examiner

ROULETTE BALL LAUNCHING SYSTEM

CROSS-REFERENCE TO RELATED APPLICATIONS

The subject matter of this application is related to the subject matter of U.S. patent application Ser. No. 15/073,498, filed Mar. 17, 2016, pending; of U.S. patent application Ser. No. 15/099,174, filed Apr. 14, 2016, pending; and of U.S. patent application Ser. No. 15/276,642, filed Sep. 26, 2016, pending.

COPYRIGHT

A portion of the disclosure of this patent document contains material that is subject to copyright protection. The copyright owner has no objection to the facsimile reproduction by anyone of the patent disclosure, as it appears in the Patent and Trademark Office patent files or records, but otherwise reserves all copyright rights whatsoever.

FIELD OF THE INVENTION

This disclosure relates generally to methods of administering wagering games for casinos and other gaming establishments, and related systems and apparatuses, and more particularly to wagering games where wagers are risked on roulette wheel spins and the final positions of the roulette ball(s) on the roulette wheel.

BACKGROUND OF THE INVENTION

Roulette is a popular wagering game played in casinos and other gaming establishments. Avid players are generally open to, and sometimes specifically seek out, new and more interesting ways to play roulette, particularly when the reward for a winning outcome at the end of a round of play, or the odds of achieving a winning outcome, may be enhanced. In addition, casino operators are always seeking new, eye-catching roulette systems and improvements that can leverage their existing facilities to better advantage.

Generally, the popularity of gaming machines and systems that present roulette games to players is dependent on the likelihood (or perceived likelihood) of winning money at the machine or table and the intrinsic entertainment value of the system relative to other available gaming options. Where the available gaming options include a number of competing systems and the expectation of winning at each gaming system is roughly the same (or believed to be the same), players are likely to be attracted to the most entertaining and exciting systems. Shrewd operators consequently strive to employ the most entertaining and exciting games, features, and enhancements available because such offerings attract frequent play and hence increase profitability to the operator. Therefore, there is a continuing need for gaming machine manufacturers to continuously develop new games and improved gaming enhancements that will attract frequent play through enhanced entertainment value to the player.

SUMMARY OF THE INVENTION

According to one embodiment of the present invention, a ball launching device includes a driver configured to impart rotary motion and a rotor connected for rotation to the driver. The ball launching device further includes a ball cup assembly mounted to the rotor. The ball cup assembly includes a first cup wall spaced apart from a second cup wall, and the rotor and the ball cup assembly are positioned inside a roulette wheel bowl proximal to a circumferential ball track in the roulette wheel bowl. The driver rotates the rotor to a launch angle with a roulette ball captured between the first and second cup walls and, when the rotor is at a designated launch angle, a launch actuator causes at least one of the first and second cup walls to move away from the other cup wall to release the roulette ball from the ball cup assembly into the ball track.

In another embodiment, a ball launching system is configured to launch a roulette ball into a roulette wheel ball track. The ball launching system comprises a support stand, a driver configured to impart rotary motion, a launch actuator, a ball loader, and a rotor mounted on the support stand for rotation by the driver about a rotor axis. The support stand positions the rotor inside a perimeter of the ball track.

A ball cup assembly is fixed to the rotor distal the rotor axis, and the ball cup assembly includes a first cup watt and second cup wall spaced oppositely apart from each other. The ball cup assembly has a retain mode during which the roulette ball is captured between at least the first and second cup walls. The ball cup assembly also has a release mode during which at least one of the first and second cup walls moves to release the roulette ball.

The ball loader of the ball launching system delivers a roulette ball to the ball cup assembly when the rotor is positioned at a loading angle. With the ball cup assembly in the retain mode capturing the roulette ball, the driver rotates the rotor to a launch angle, and the launch actuator causes the ball cup assembly to switch to the launch mode to release the roulette ball into the ball track.

According to yet another embodiment of the invention, a method of conducting a roulette game with a ball launching system is disclosed. The ball launching system is mounted proximal to a roulette wheel and includes a rotor rotating substantially parallel to a plane of a roulette wheel ball track and a ball cup fixed to the rotor. The method includes spinning the roulette wheel and receiving a player input at a signal button to activate the ball launching system. In response to receiving a signal from the signal button, the method further includes rotating, via a driver configured to impart rotary motion, the rotor to a designated launch angle. In response to the rotor being at the launch angle, the method further includes triggering a launch of a roulette ball captured between a first and second cup wall of the ball cup by causing at least one of the first and second cup wall to move away from the other cup wall and release the ball into the roulette wheel ball track.

Additional embodiments of the invention will be apparent to those of ordinary skill in the art in view of the detailed description of various embodiments, which is made with reference to the drawings, a brief description of which is provided below.

BRIEF DESCRIPTION OF THE DRAWINGS

The drawings described below have been timely submitted with this specification and are incorporated herein by reference in their entirety.

Figure 1:
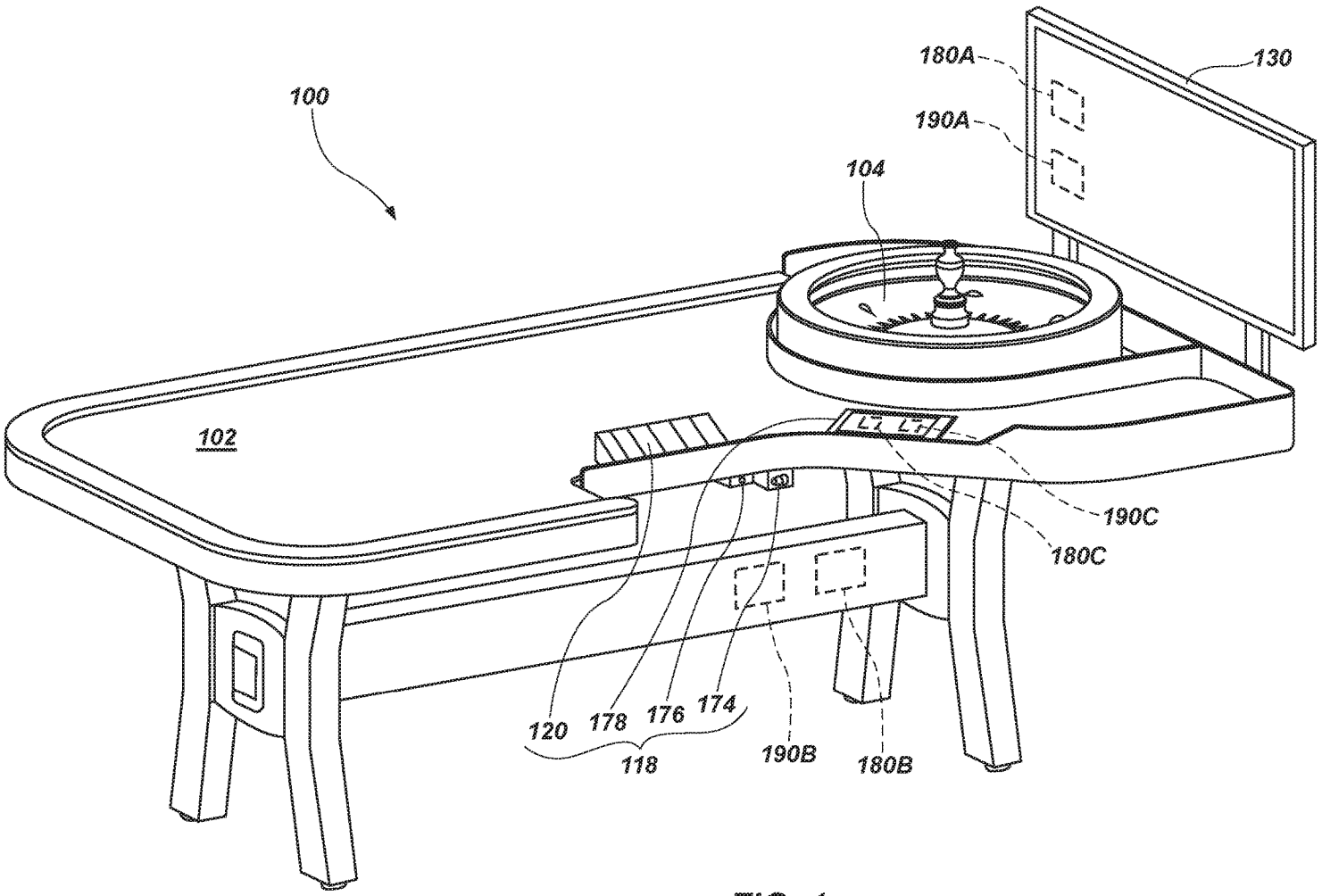
FIG. 1 is a perspective view of an exemplary roulette table that may be utilized to administer a roulette game.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION

The illustrations presented in this disclosure are not meant to be actual views of any particular act and/or element in a method, apparatus, system, or component thereof, but are merely idealized representations employed to describe illustrative embodiments. Thus, the drawings are not necessarily to scale. Additionally, elements common between figures may retain the same or similar numerical designation. Elements with the same number, but including a different alphabet character as a suffix should be considered as multiple instantiations of substantially similar elements and may be referred to generically without an alphabet character suffix.

The terms "gaming," "gambling," or the like, refer to activities, games, sessions, rounds, hands, rolls, operations, and other events related to wagering games, the outcome of which is at least partially based on one or more random events ("chance" or "chances"), and on which wagers may be placed by a player. In addition, the words "wager," "bet," "bid," or the like, refer to any type of wager, bet, or gaming venture that is placed on random events, whether of monetary or non-monetary value. Points, credits, and other items of value may be purchased, earned, or otherwise issued prior to beginning the wagering game. In some embodiments, purchased points, credits, or other items of value may have an exchange rate that is not one-to-one to the currency used by the user. For example, a wager may include money, points, credits, symbols, or other items that may have some value related to a wagering game. Wagers may be placed in wagering games that involve the risk of real-world monetary value for the potential of payouts with real-world monetary value (e.g., the "play-for-pay," such as "house-banked" and "player-banked," configurations, each of which is described in more detail below) or in wagering games that involve no real-world monetary risks for the player (e.g., the "play-for-fun" and "social play-for-fun" configurations described in more detail below).

As used herein, the term "wager" includes any form of wagering value, including money, casino chips, other physical means for payment, and online or remote electronic authorization of a wager in any acceptable form to the casino or online or virtual game host. Also included are physical representations of money (e.g., casino chips) at a local game, as well as virtual representations of money in the form of electronic authorizations of a transfer of money and digital representations of money (e.g., digital representations of bills or coins, digital representations of chips, numerical quantities of money, numerical quantities of points, or numerical quantities of credits) at a local or remote electronic gaming device. As used herein, the term "wagering element" means and includes objects and symbols used to signify the acceptance of a wager. For example, physical wagering elements include physical money (e.g., bills and coins) and physical wagering tokens (e.g., casino chips), which may or may not be redeemable for monetary value and may or may not include electronic identifiers (e.g., RFID chips) embedded within the tokens, enabling electronic sensing and tracking of wagering. Virtual wagering elements include, for example, images (e.g., images of money or poker chips) and text (e.g., a string of numbers), which may or may not be redeemable for monetary value. In the "play-for-fun" and "social play-for-fun" configurations, a "wager" may not have a cash value (i.e., a real-world monetary value).

For the purposes of this description, it will be understood that when an action related to accepting wagers, generating roulette outcomes, making payouts, accepting selection of roulette outcomes, or other actions associated with a player or a croupier is described herein, and such description includes a player or a croupier taking the action, some results of the action may be computer generated and may be displayed on a live or virtual table or electronic display, and, if applicable, the reception or detection of such an action in an electronic form where player and croupier choices, selections, or other actions are received at an electronic interface. Also included is the representation of the invention and corresponding physical roulette wheel on a display or displays, and, if applicable to the action described, an electronic reception of an indication that the roulette outcome has been received, selected, or otherwise interacted with at a location associated with a player, or, associated with a virtual player.

Various platforms are contemplated that are suitable for implementation of embodiments of wagering games according to this disclosure. For example, embodiments of wagering games may be implemented as live table games with an in-person croupier, partially or fully automated table games, and partially or fully automated, network-administered games (e.g., Internet games) wherein game results may be produced utilizing a live video feed of a croupier administering a game from a remote studio.

For example, in one embodiment, the players may be remotely located from a live croupier, and a live croupier and a roulette table may be displayed to players on their monitors via a video feed. The players' video feeds may be transmitted to the croupier and may also be shared among the players at the table. In a sample embodiment, a central station may include a plurality of betting-type game devices and an electronic camera for each game device. A plurality of player stations, remotely located with respect to the central station, may each include a monitor for displaying a selected game device at the central station, and input means for selecting a game device and for placing a bet by a player at the player's station relating to an action involving an element of chance to occur at the selected game device. Further details on gambling systems and methods for remotely-located players are disclosed in U.S. Pat. No. 6,755,741, issued Jun. 29, 2004 titled "GAMBLING GAME SYSTEM AND METHOD FOR REMOTELY-LOCATED PLAYERS," the disclosure of which is incorporated herein in its entirety by this reference.

FIG. 1 is a perspective side view of an embodiment of a roulette table 100 configured for implementation of embodiments of wagering games in accordance with the present disclosure. The table 100 may include a playing surface 102, which may be, for example, a felt layout or an electronic display. The table 100 may further include a physical roulette wheel 104 proximate to, and in some embodiments supported by, the playing surface 102. The table 100 may include a video display 130 configured to display game information, such as, for example, the information described subsequently in connection with FIG. 2, and any other information considered useful to the players, including acceptance of wagers, game outcomes, wager outcomes, payout multipliers, historical game outcome data, and other information, in real-time.

In some embodiments, the playing surface 102 may include an electronic bet sensor to electronically recognize the placement of a specific type of chip (e.g., bonus wager or conventional roulette wager) of a fixed denomination. In some embodiments, the electronic bet sensor may also be configured to determine the denomination of the chip. In still other embodiments, the electronic bet sensor may be able to detect one or more denominations of a plurality of stacked chips included in the wager. In some embodiments, the wager can be any size within house limits.

The table 100 may include features for at least partially automating administration of a wagering game using the table 100. For example, the table 100 may include a croupier interface 118, which may enable an in-person administrator (e.g., a croupier) to initiate automated administration of certain actions and to personally perform other actions associated with administering a wagering game. The croupier interface 118 may include, for example, a croupier chip tray 120, which may be configured to support house chips, to which lost wagers may be added, and from which payouts may be paid. The croupier interface 118 may include a player authenticator 174 (e.g., a magnetic strip reader for cards carrying player information encoded on a magnetic strip), which may be configured to verify the identity of a player and grant access to a player account for the purpose of paying payouts, granting complimentary items and services (i.e., "comps") to players, redeeming chips for monetary value and vice versa, or performing other actions requiring a player's verified identity. The croupier interface 118 may include game initiation and control devices, such as, for example, buttons 176 and touchscreens 178, which may be configured to initiate random game events, verify authorization for large payout awards, enter wagering or outcome information for the purpose of game tracking, activating and deactivating automated portions of game administration (e.g., turning the table 100 and associated components on and off), and performing other actions to initiate and control the automatic administration of the wagering game.

The table 100 may include at least one processor 180, which may be associated, for example, with the video display 130 (e.g., processor 180A), the table 100 itself (e.g., processor 180B), or the touchscreen 178 (e.g., processor 180C) of the croupier interface 118. The one or more processors 180 may access game rules and game assets (e.g., videos, images, and text) stored in at least one nontransitory memory 190, which may similarly be associated, for example, with the video display 130 (e.g., memory 190A), the table 100 itself (e.g., memory 190B), or the touchscreen 178 (e.g., memory 190C) of the croupier interface 118. For example, the one or more processors 180 may interpret a random game outcome, declare winning wager conditions, and control display of information on the video display 130.

At least some of the actions performed in connection with administering a wagering game using the table 100 may be accomplished by an in-person croupier. For example, wagers may be accepted by a croupier permitting a player to place a chip in a designated area on the playing surface 102, and payouts may be paid by the croupier giving chips from a croupier chip tray 120 to a player, for example, by placing them on the playing surface 102 proximate the player. Other actions performed in connection with administering a wagering game using the table 100 may be accomplished automatically by one or more processors 180, which may occur in response to croupier input or may occur automatically in response to other game events. For example, one or more processors 180 may automatically interpret a random game outcome (e.g., using sensors in the physical roulette wheel 104 or using imaging sensors configured to capture information from the physical roulette wheel 104), and may apply game rules and display all winning game conditions associated with the random game outcomes on the video display 130.

Figure 2:
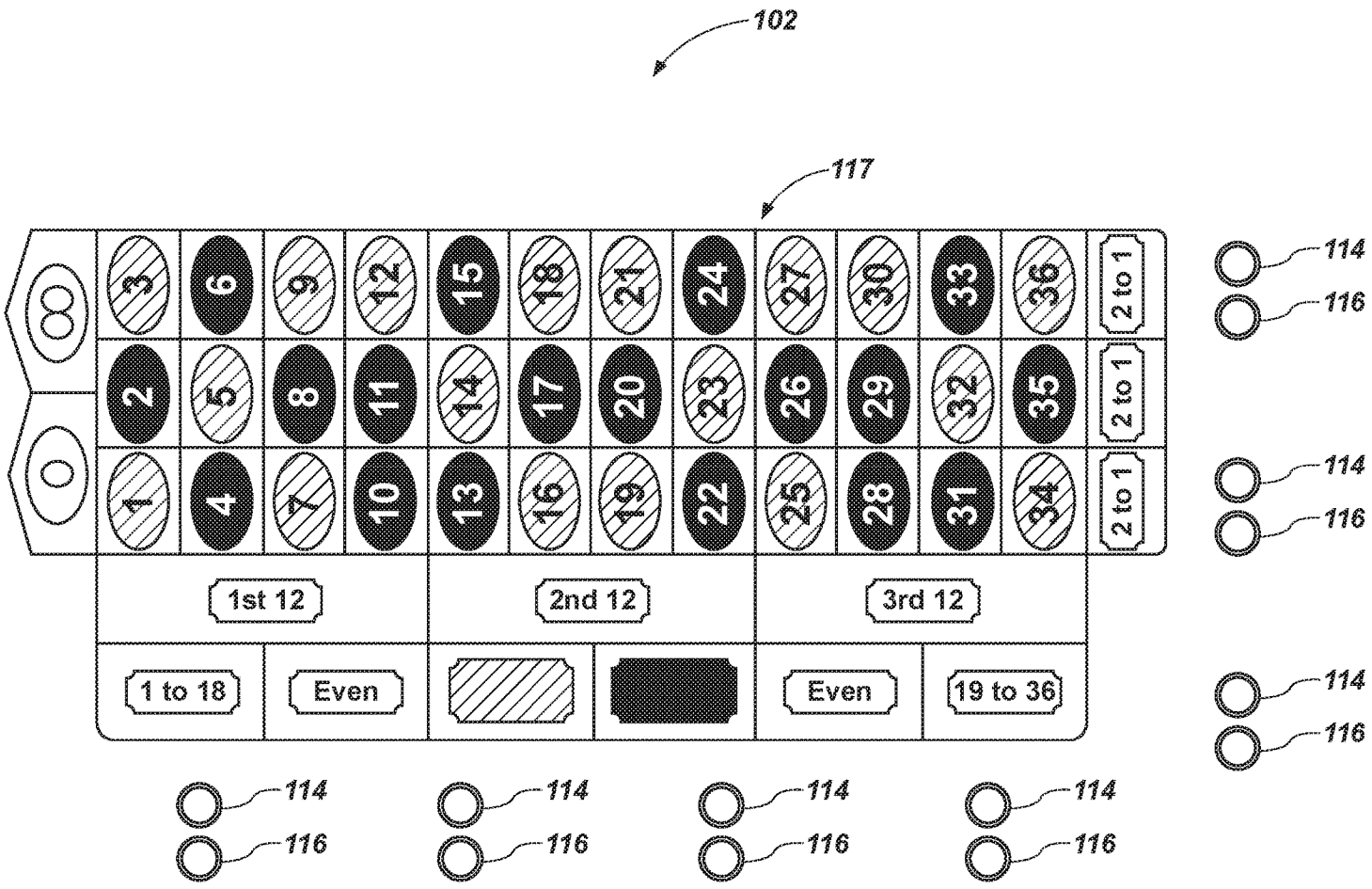
FIG. 2 is a diagram of an exemplary playing surface for implementation of a method of administering a roulette game.

FIG. 2 is a diagram of an exemplary playing surface 102 for implementing wagering games within the scope of this disclosure. Such an implementation may be, for example, a felt layout on a physical gaming table or an electronic representation on an electronic display. The playing surface 102 may also include roulette wager areas 114, 116 at multiple player positions from which wagering elements associated with conventional roulette wagering may be retrieved.

The playing surface 102 may further include a wagering area 117, in which conventional roulette wagers, and any other wagers may be accepted. The wagering area 117 may be the same as or similar to wagering areas described in U.S. patent application Ser. No. 13/631,598, filed Sep. 28, 2012, for "SYSTEMS, METHODS, AND DEVICES FOR DISPLAYING HISTORICAL ROULETTE INFORMATION." Briefly, the wagering area 117 may be configured for acceptance of bonus, odds, evens, red, black, split, box, specific number and color, and other roulette bets, wherein the receipt of a wagering element within a specific area, on a border between areas, or at an intersection among areas may reflect receipt of a predicted roulette outcome or a predicted characteristic of a roulette outcome. In some embodiments, the playing surface 102 may include an area for electronically showing the outcome of randomly generated roulette outcomes or a roulette wheel into which a ball may be introduced to randomly generate a roulette outcome.

Figure 3:
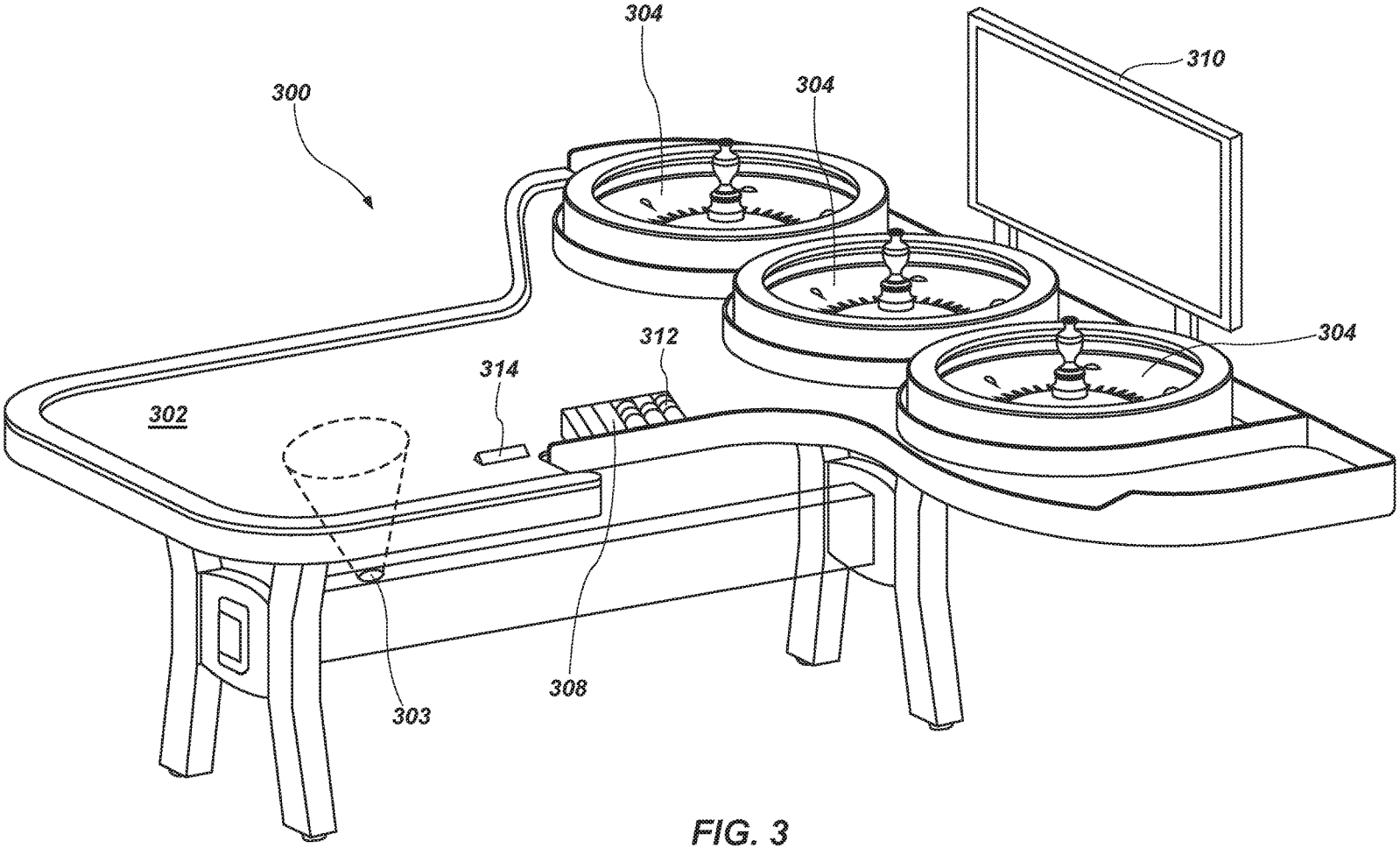
FIG. 3 is a perspective view of an exemplary multi-wheel roulette table.

FIG. 3 is a perspective view of an embodiment of a gaming table 300 for implementing wagering games in accordance with this disclosure. The gaming table 300 may be a physical article of furniture around which participants in the wagering game may stand or sit and on which the physical objects used for administering and otherwise participating in the wagering game may be supported, positioned, moved, transferred, and otherwise manipulated. For example, the gaming table 300 may include a gaming surface 302 on which the physical objects used in administering the wagering game may be located. The gaming surface 302 may be, for example, a felt fabric covering a hard surface of the table 300, and a design, conventionally referred to as a "layout," specific to the game being administered may be physically printed on the gaming surface 302. As another example, the gaming surface 302 may be a surface of a transparent or translucent material (e.g., glass or plexiglass) onto which a projector 303, which may be located, for example, above or below the gaming surface 302, may illuminate a layout specific to the wagering game being administered. In such an example, the specific layout projected onto the gaming surface 302 may be changeable, enabling the gaming table 300 to be used to administer different variations of wagering games within the scope of this disclosure or other wagering games. Additional details of illustrative gaming surfaces and projectors are disclosed in U.S. patent application Ser. No. 13/919,849, filed Jun. 17, 2013, and titled "ELECTRONIC GAMING DISPLAYS, GAMING TABLES INCLUDING ELECTRONIC GAMING DISPLAYS AND RELATED ASSEMBLIES, SYSTEMS AND METHODS," the disclosure of which is incorporated herein in its entirety by this reference. In either example, the gaming surface 302 may include, for example, designated areas for player positions; areas in which wagering elements of specific types may be stored; areas in which wagers may be accepted; areas in which wagers may be grouped into pots; and areas in which rules, pay tables, and other instructions related to the wagering game may be displayed. As a specific, nonlimiting example, the gaming surface 302 may be configured as shown in FIG. 2.

In some embodiments, the gaming table 300 may include a display 310 separate from the gaming surface 302. The display 310 may be configured to face players, prospective players, and spectators and may display, for example, rules, paytables, real-time game status, such as wagers accepted and cards dealt, historical game information, such as amounts won, amounts wagered, percentage of hands won, and notable hands achieved, and other instructions and information related to the wagering game. The display 310 may be a physically fixed display, such as a poster, in some embodiments. In other embodiments, the display 310 may change automatically in response to a stimulus (e.g., may be an electronic video monitor).

The gaming table 300 may include particular machines and apparatuses configured to facilitate the administration of the wagering game. For example, the gaming table 300 may include one or more physical roulette wheels 304. More specifically, the gaming table 300 may include three separate roulette wheels 304, which may generate independently randomized roulette outcomes. The roulette wheels 304 may include, for example, a spinning, recessed surface and a series of numbered and colored pockets into which an outcome identifier (e.g., a ball) may come to rest. The outcome identifiers may be manually introduced into the roulette wheels 304 by a croupier or may be automatically introduced into the roulette wheels 304 by identifier introduction mechanisms. The roulette wheels 304 may simply be supported on the gaming surface 302 in some embodiments. In other embodiments, the roulette wheels 304 may be mounted into the gaming surface 302 such that the roulette wheels 304 are not manually removable from the gaming surface 302 without the use of tools.

The gaming table 300 may include one or more chip racks 308 configured to facilitate accepting wagers, transferring lost wagers to the house, and exchanging monetary value for wagering elements 312 (e.g., chips). For example, the chip rack 308 may include a series of token support rows, each of which may support tokens of a different type (e.g., color and denomination). In some embodiments, the chip rack 308 may be configured to automatically present a selected number of chips using a chip-cutting-and-delivery mechanism. Additional details of an illustrative chip rack 308 and chip-cutting-and-delivery mechanism are found in U.S. Pat. No. 7,934,980, issued May 3, 2011, to Blaha et al., the disclosure of which is incorporated herein in its entirety by this reference. In some embodiments, the gaming table 300 may include a drop box 314 for money that is accepted in exchange for wagering elements 312. The drop box 314 may be, for example, a secure container (e.g., a safe or lockbox) having a one-way opening into which money may be inserted and a secure, lockable opening from which money may be retrieved. Such drop boxes 314 are known in the art, and may be incorporated directly into the gaming table 300 and may, in some embodiments, have a removable container for the retrieval of money in a separate, secure location.

When administering a wagering game in accordance with embodiments of this disclosure, a croupier may receive money (e.g., cash) from a player in exchange for wagering elements 312. The croupier may deposit the money in the drop box 314 and transfer physical wagering elements 312 to the player. The croupier may accept one or more initial wagers (e.g., antes and other wagers from the player, which may be reflected by the croupier permitting the player to place one or more wagering elements 312 or other wagering tokens (e.g., cash) within designated areas on the gaming surface 302 associated with the various wagers of the wagering game. Once all wagers have been accepted, outcome identifiers may be introduced into the roulette wheels 304 and permitted to come to rest on three individually randomized roulette outcomes.

Finally, the croupier may resolve the wagers, award payouts to the players, which may be accomplished by giving wagering elements 312 from the chip rack 308 to the players, resetting progressive wagers, which may be accomplished by transferring wagering elements designated for placing the progressive wagers to players or transferring them to the chip rack 308, and transferring losing, nonprogressive wagers to the house, which may be accomplished by moving wagering elements 312 from the gaming surface 302 to the chip rack 308.

Figure 4:
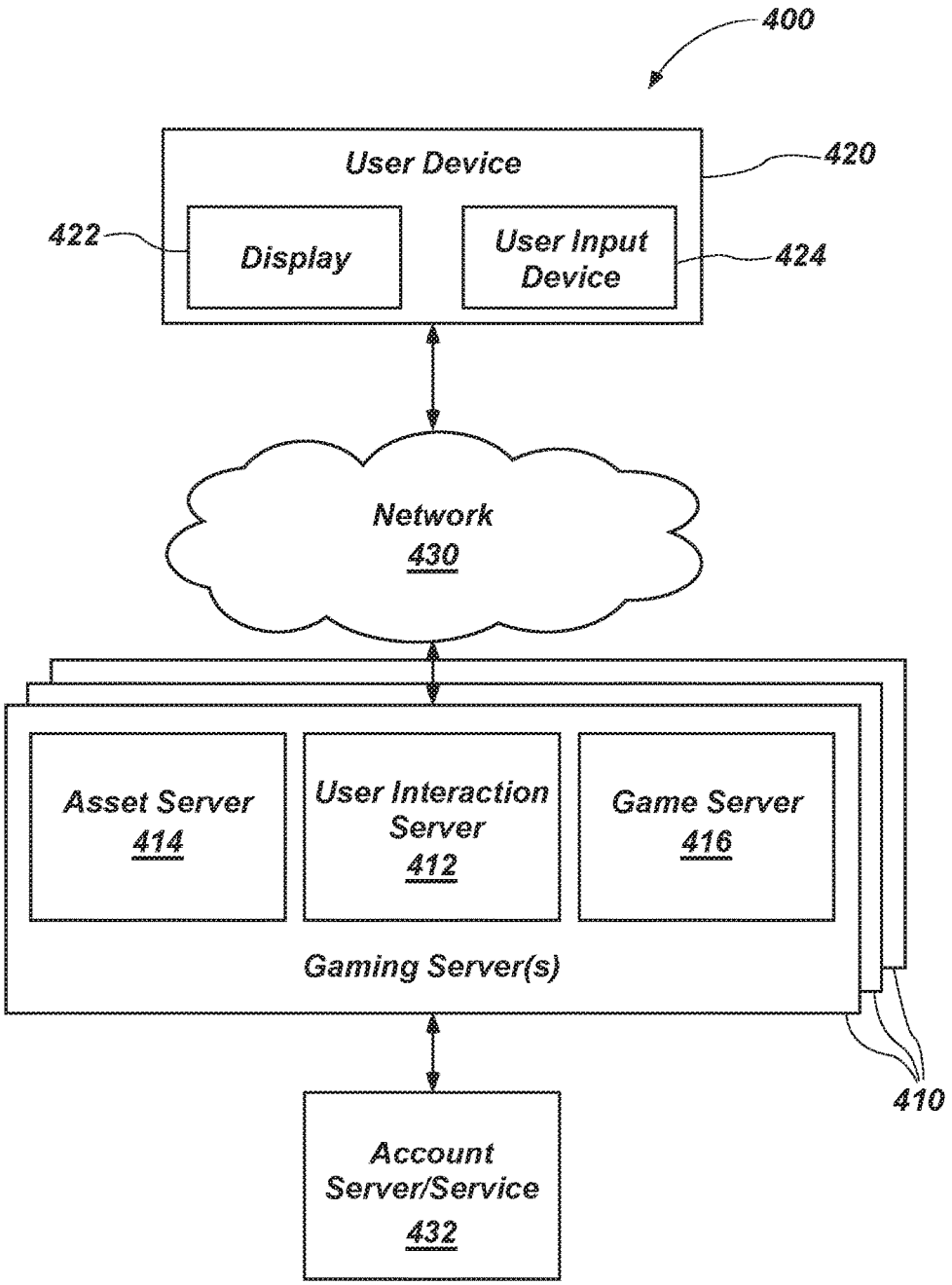
FIG. 4 is a schematic block diagram of a gaming system for implementing embodiments of roulette games in accordance with this disclosure.

In some embodiments, wagering games in accordance with this disclosure may be administered using a gaming system employing a client-server architecture (e.g., over the Internet, a local area network, etc.). FIG. 4 is a schematic block diagram of an illustrative gaming system 400 for implementing wagering games according to this disclosure. The gaming system 400 may enable end users to remotely access game content. Such game content may include, without limitation, various types of wagering games such as card games, dice games, big wheel games, roulette, scratch off games ("scratchers"), and any other wagering game where the game outcome is determined, in whole or in part, by one or more random events. This includes, but is not limited to, Class II and Class III games as defined under 25 U.S.C. § 2701 et seq. ("Indian Gaming Regulatory Act"). Such games may include banked and/or non-banked games.

The wagering games supported by the gaming system 400 may be operated with real currency or with virtual credits or other virtual (e.g., electronic) value indicia. For example, the real currency option may be used with traditional casino and lottery-type wagering games in which money or other items of value are wagered and may be cashed out at the end of a game session. The virtual credits option may be used with wagering games in which credits (or other symbols) may be issued to a player to be used for the wagers. A player may be credited with credits in any way allowed, including, but not limited to, a player purchasing credits; being awarded credits as part of a contest or a win event in this or another game (including non-wagering games); being awarded credits as a reward for use of a product, casino, or other enterprise, time played in one session, or games played; or may be as simple as being awarded virtual credits upon logging in at a particular time or with a particular frequency, etc. Although credits may be won or lost, the ability of the player to cash out credits may be controlled or prevented. In one example, credits acquired (e.g., purchased or awarded) for use in a play-for-fun game may be limited to non-monetary redemption items, awards, or credits usable in the future or for another game or gaming session. The same credit redemption restrictions may be applied to some or all of credits won in a wagering game as well.

An additional variation includes web-based sites having both play-for-fun and wagering games, including issuance of free (non-monetary) credits usable to play the play-for-fun games. This feature may attract players to the site and to the games before they engage in wagering. In some embodiments, a limited number of free or promotional credits may be issued to entice players to play the games. Another method of issuing credits includes issuing free credits in exchange for identifying friends who may want to play. In another embodiment, additional credits may be issued after a period of time has elapsed to encourage the player to resume playing the game. The gaming system 400 may enable players to buy additional game credits to allow the player to resume play. Objects of value may be awarded to play-for-fun players, which may or may not be in a direct exchange for credits. For example, a prize may be awarded or won for a highest scoring play-for-fun player during a defined time interval. All variations of credit redemption are contemplated, as desired by game designers and game hosts (the person or entity controlling the hosting systems).

The gaming system 400 may include a gaming platform to establish a portal for an end user to access a wagering game hosted by one or more gaming servers 410 over a network 430. In some embodiments, games are accessed through a user interaction service 412. The gaming system 400 enables players to interact with a user device 420 through a user input device 424 and a display 422 and to communicate with one or more gaming servers 410 using a network 430 (e.g., the Internet). Typically, the user device is remote from the gaming server 410 and the network is the world-wide web (i.e., the Internet).

In some embodiments, the gaming servers 410 may be configured as a single server to administer wagering games in combination with the user device 420. In other embodiments, the gaming servers 410 may be configured as separate servers for performing separate, dedicated functions associated with administering wagering games. Accordingly, the following description also discusses "services" with the understanding that the various services may be performed by different servers or combinations of servers in different embodiments. As shown in FIG. 4, the gaming servers 410 may include a user interaction service 412, a game service 416, and an asset service 414. In some embodiments, one or more of the gaming servers 410 may communicate with an account server 432 performing an account service 432. As explained more fully below, for some wagering type games, the account service 432 may be separate and operated by a different entity than the gaming servers 410; however, in some embodiments the account service 432 may also be operated by one or more of the gaming servers 410.

The user device 420 may communicate with the user interaction service 412 through the network 430. The user interaction service 412 may communicate with the game service 416 and provide game information to the user device 420. In some embodiments, the game service 416 may also include a game engine. The game engine may, for example, access, interpret, and apply game rules. In some embodiments, a single user device 420 communicates with a game provided by the game service 416, while other embodiments may include a plurality of user devices 420 configured to communicate and provide end users with access to the same game provided by the game service 416. In addition, a plurality of end users may be permitted to access a single user interaction service 412, or a plurality of user interaction services 412, to access the game service 416. The user interaction service 412 may enable a user to create and access a user account and interact with game service 416. The user interaction service 412 may enable users to initiate new games, join existing games, and interface with games being played by the user.

The user interaction service 412 may also provide a client for execution on the user device 420 for accessing the gaming servers 410. The client provided by the gaming servers 410 for execution on the user device 420 may be any of a variety of implementations depending on the user device 420 and method of communication with the gaming servers 410. In one embodiment, the user device 420 may connect to the gaming servers 410 using a web browser, and the client may execute within a browser window or frame of the web browser. In another embodiment, the client may be a stand-alone executable on the user device 420.

For example, the client may comprise a relatively small amount of script (e.g., JAVASCRIPT®), also referred to as a "script driver," including scripting language that controls an interface of the client. The script driver may include simple function calls requesting information from the gaming servers 410. In other words, the script driver stored in the client may merely include calls to functions that are externally defined by, and executed by, the gaming servers 410. As a result, the client may be characterized as a "thin client." The client may simply send requests to the gaming servers 410 rather than performing logic itself. The client may receive player inputs, and the player inputs may be passed to the gaming servers 410 for processing and executing the wagering game. In some embodiments, this may involve providing specific graphical display information for the display 422 as well as game outcomes.

As another example, the client may comprise an executable file rather than a script. The client may do more local processing than does a script driver, such as calculating where to show what game symbols upon receiving a game outcome from the game service 416 through user interaction service 412. In some embodiments, portions of an asset service 414 may be loaded onto the client and may be used by the client in processing and updating graphical displays. Some form of data protection, such as end-to-end encryption, may be used when data is transported over the network 430. The network 430 may be any network, such as, for example, the Internet or a local area network.

The gaming servers 410 may include an asset service 414, which may host various media assets (e.g., text, audio, video, and image files) to send to the user device 420 for presenting the various wagering games to the end user. In other words, the assets presented to the end user may be stored separately from the user device 420. For example, the user device 420 requests the assets appropriate for the game played by the user; as another example, especially relating to thin clients, just those assets that are needed for a particular display event will be sent by the gaming servers 410, including as few as one asset. The user device 420 may call a function defined at the user interaction service 412 or asset service 414, which may determine which assets are to be delivered to the user device 420 as well as how the assets are to be presented by the user device 420 to the end user. Different assets may correspond to the various user devices 420 and their clients that may have access to the game service 416 and to different variations of wagering games.

The gaming servers 410 may include the game service 416, which may be programmed to administer wagering games and determine game play outcomes to provide to the user interaction service 412 for transmission to the user device 420. For example, the game service 416 may include game rules for one or more wagering games, such that the game service 416 controls some or all of the game flow for a selected wagering game as well as the determined game outcomes. The game service 416 may include pay tables and other game logic. The game service 416 may perform random number generation for determining random game elements of the wagering game. In one embodiment, the game service 416 may be separated from the user interaction service 412 by a firewall or other method of preventing unauthorized access to the game service 416 by the general members of the network 430.

The user device 420 may present a gaming interface to the player and communicate the user interaction from the user input device 424 to the gaming servers 410. The user device 420 may be any electronic system capable of displaying gaming information, receiving user input, and communicating the user input to the gaming servers 410. For example, the user device 420 may be a desktop computer, a laptop, a tablet computer, a set-top box, a mobile device (e.g., a smartphone), a kiosk, a terminal, or another computing device. As a specific, nonlimiting example, the user device 420 operating the client may be an interactive electronic gaming system. The client may be a specialized application or may be executed within a generalized application capable of interpreting instructions from an interactive gaming system, such as a web browser.

The client may interface with an end user through a web page or an application that runs on a device including, but not limited to, a smartphone, tablet, or a general computer, or the client may be any other computer program configurable to access the gaming servers 410. The client may be illustrated within a casino webpage (or other interface) indicating that the client is embedded into a webpage, which is supported by a web browser executing on the user device 420.

In some embodiments, components of the gaming system 400 may be operated by different entities. For example, the user device 420 may be operated by a third party, such as a casino or an individual, that links to the gaming servers 410, which may be operated, for example, by a wagering game service provider. Therefore, in some embodiments, the user device 420 and client may be operated by a different administrator than the operator of the game service 416. In other words, the user device 420 may be part of a third-party system that does not administer or otherwise control the gaming servers 410. In other embodiments, the user interaction service 412 and asset service 414 may be operated by a third-party system. For example, a gaming entity (e.g., a casino) may operate the user interaction service 412, user device 420, or combination thereof to provide its customers access to game content managed by a different entity that may control the game service 416, amongst other functionality. In still other embodiments, all functions may be operated by the same administrator. For example, a gaming entity (e.g., a casino) may elect to perform each of these functions in-house, such as providing access to the user device 420, delivering the actual game content, and administering the gaming system 400.

The gaming servers 410 may communicate with one or more external account servers 432 (also referred to herein as an account service 432), optionally through another firewall. For example, the gaming servers 410 may not directly accept wagers or issue payouts. That is, the gaming servers 410 may facilitate online casino gaming but may not be part of a self-contained online casino itself. Another entity (e.g., a casino or any account holder or financial system of record) may operate and maintain its external account service 432 to accept bets and make payout distributions. The gaming servers 410 may communicate with the account service 432 to verify the existence of funds for wagering and to instruct the account service 432 to execute debits and credits. As another example, the gaming servers 410 may directly accept bets and make payout distributions, such as in the case where an administrator of the gaming servers 410 operates as a casino.

Additional features may be supported by the gaming servers 410, such as hacking and cheating detection, data storage and archival, metrics generation, messages generation, output formatting for different end user devices, as well as other features and operations. For example, the gaming servers 410 may include additional features and configurations as described in U.S. patent application Ser. No. 13/353,194, filed Jan. 18, 2012, and U.S. patent application Ser. No. 13/609,031, filed Sep. 10, 2012, both applications titled "NETWORK GAMING ARCHITECTURE, GAMING SYSTEMS, AND RELATED METHODS," the disclosure of each of which is incorporated herein in its entirety by this reference.

Figure 5:
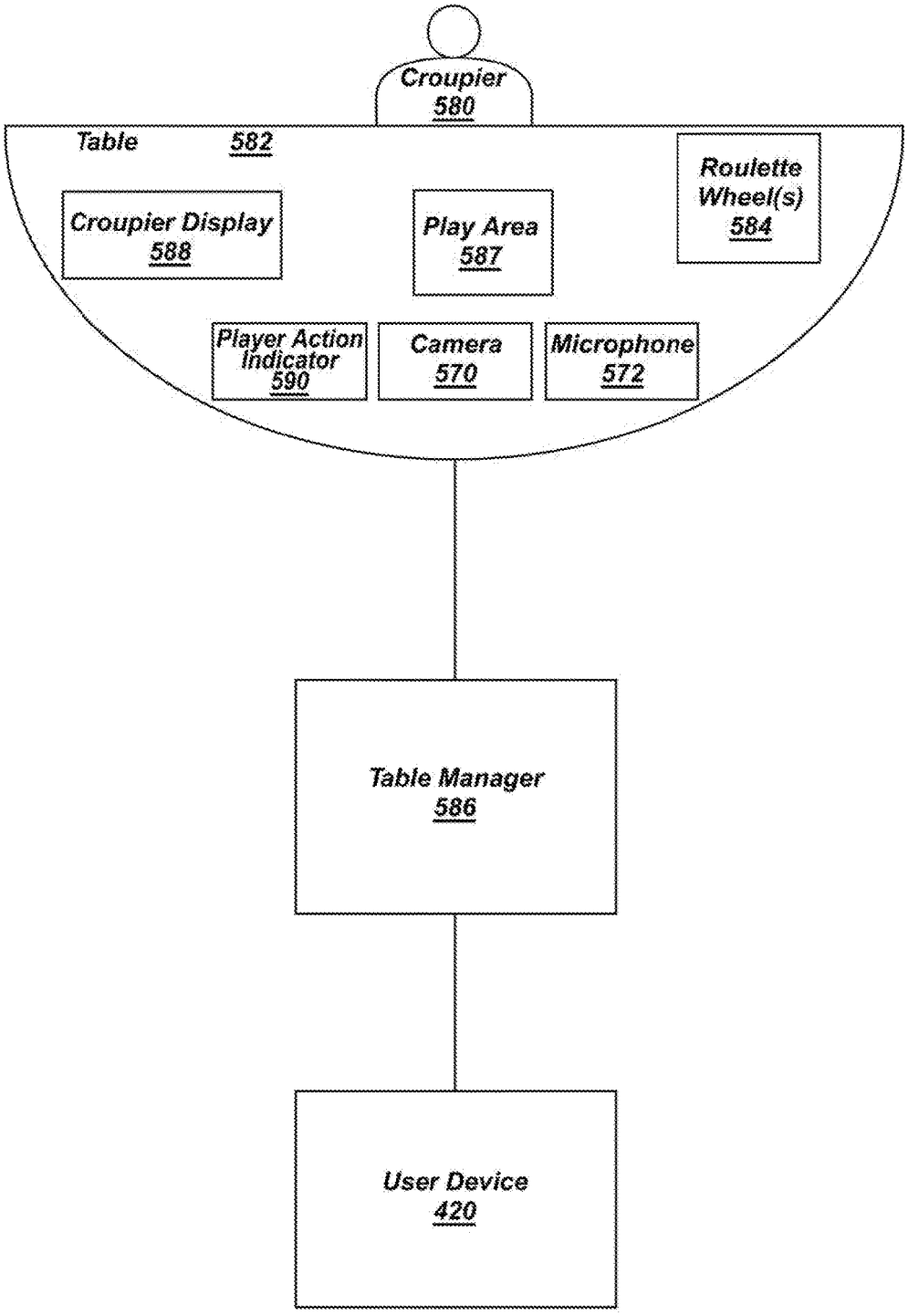
FIG. 5 is a schematic block diagram of a gaming system for implementing embodiments of wagering games including a live croupier feed.

FIG. 5 is a schematic block diagram of an exemplary system for implementing wagering games including a live croupier feed. Features of the gaming system 400 described above in connection with FIG. 4 may be utilized in connection with this embodiment, except as further described. Rather than roulette outcomes being generated by computerized random processes, a physical outcome identifier or identifiers (e.g., balls or marbles) may be introduced into one or more corresponding physical roulette wheels 584 by a live croupier 580 at a table 582. A table manager 586 may assist the croupier 580 in facilitating play of the game by transmitting a video feed of the croupier's actions to the user device 420 and transmitting player elections to the croupier 580. As described above, the table manager 586 may act as or communicate with a gaming system 400 (see FIG. 4) (e.g., acting as the gaming system 400 (see FIG. 4)) itself or as an intermediate client interposed between and operationally connected to the user device 420 and the gaming system 400 (see FIG. 4) to provide gaming at the table 582 to users of the gaming system 400 (see FIG. 4). Thus, the table manager 586 may communicate with the user device 420 through a network 430 (see FIG. 4) and may be a part of a larger online casino, or may be operated as a separate system facilitating game play. In various embodiments, each table 582 may be managed by an individual table manager 586 constituting a gaming device, which may receive and process information relating to that table. For simplicity of description, these functions are described as being performed by the table manager 586, though certain functions may be performed by an intermediary gaming system 400 (see FIG. 4), such as the one shown and described in connection with FIG. 4. In some embodiments, the gaming system 400 (see FIG. 4) may match remotely located players to tables 582 and facilitate transfer of information between user devices 420 and tables 582, such as wagering amounts and player option elections, without managing gameplay at individual tables. In other embodiments, functions of the table manager 586 may be incorporated into a gaming system 400 (see FIG. 4).

The table 582 includes a camera 570 and optionally a microphone 572 to capture video and audio feeds relating to the table 582. The camera 570 may be trained on the croupier 580, play area 587, and roulette wheel or wheels 584. As the game is administered by the croupier 580, the video feed captured by the camera 570 may be shown to the player using the user device 420, and any audio captured by the microphone 572 may be played to the player using the user device 420. In some embodiments, the user device 420 may also include a camera, microphone, or both, which may also capture feeds to be shared with the croupier 580 and other players. In some embodiments, the camera 570 may be trained to capture images of the roulette outcomes, chips, and chip stacks on the surface of the gaming table. Known image extraction techniques may be used to obtain roulette outcomes from the images of the roulette wheel or wheels 584. An example of suitable image extraction software is disclosed in U.S. Pat. No. 7,901,285, issued Mar. 8, 2011, to Tran et al., the disclosure of which is incorporated in this disclosure in its entirety by this reference.

Roulette outcome data in some embodiments may be used by the table manager 586 to determine game outcome. The data extracted from the camera 570 may be used to confirm roulette outcome data obtained from the roulette wheel or wheels 584 (e.g., using sensors and for general security monitoring purposes, such as detecting player or croupier outcome or wager manipulation, for example. Examples of roulette outcome data include, for example, number and color information of a roulette outcome and number and color information of each roulette outcome in a set of roulette outcomes (e.g., three roulette outcomes from the same round of play).

The live video feed permits the croupier to use one or more physical roulette wheels and play the game as though the player were at a live casino. In addition, the croupier can prompt a user by announcing a player's election is to be performed. In embodiments where a microphone 572 is included, the croupier 580 can verbally announce action or request an election by a player. In some embodiments, the user device 420 also includes a camera or microphone, which also captures feeds to be shared with the croupier 580 and other players.

Player elections may be transmitted to the table manager 586, which may display player elections to the croupier 580 using a croupier display 588 and player action indicator 590 on the table 582. For example, the croupier display 588 may display information regarding when to close betting, when to introduce an outcome identifier into a physical, spinning roulette wheel 584, or which player position is responsible for the next action.

In some embodiments, the table manager 586 may receive roulette outcome information from each roulette wheel 584. For example, the roulette wheel or wheels 584 may include sensors to detect specific spaces on the roulette wheel and which space an outcome identifier is positioned on. In some embodiments, the table manager 586 may generate roulette outcome information (e.g., alone or in addition to the information received from one or more roulette wheels 584).

The table manager 586 may apply game rules to the roulette outcome information, along with the accepted player decisions, to determine gameplay events and wager results. Alternatively, the wager results may be determined by the croupier 580 and input to the table manager 586, which may be used to confirm automatically determined results by the gaming system.

Roulette outcome data in some embodiments may be used by the table manager 586 to determine game outcome. The data extracted from the camera 570 may be used to confirm the data obtained from the roulette wheel or wheels 584 and for general security monitoring purposes, such as detecting player or croupier outcome or wager manipulation, for example.

The live video feed permits the croupier to physically generate one or more randomized roulette outcomes and play the game as though the player were at a live casino. In addition, the croupier can prompt a user by announcing a player's election is to be performed. In embodiments where a microphone 572 is included, the croupier 580 can verbally announce action or request an election by a player. In some embodiments, the user device 420 also includes a camera or microphone, which also captures feeds to be shared with the croupier 580 and other players.

Figure 6:
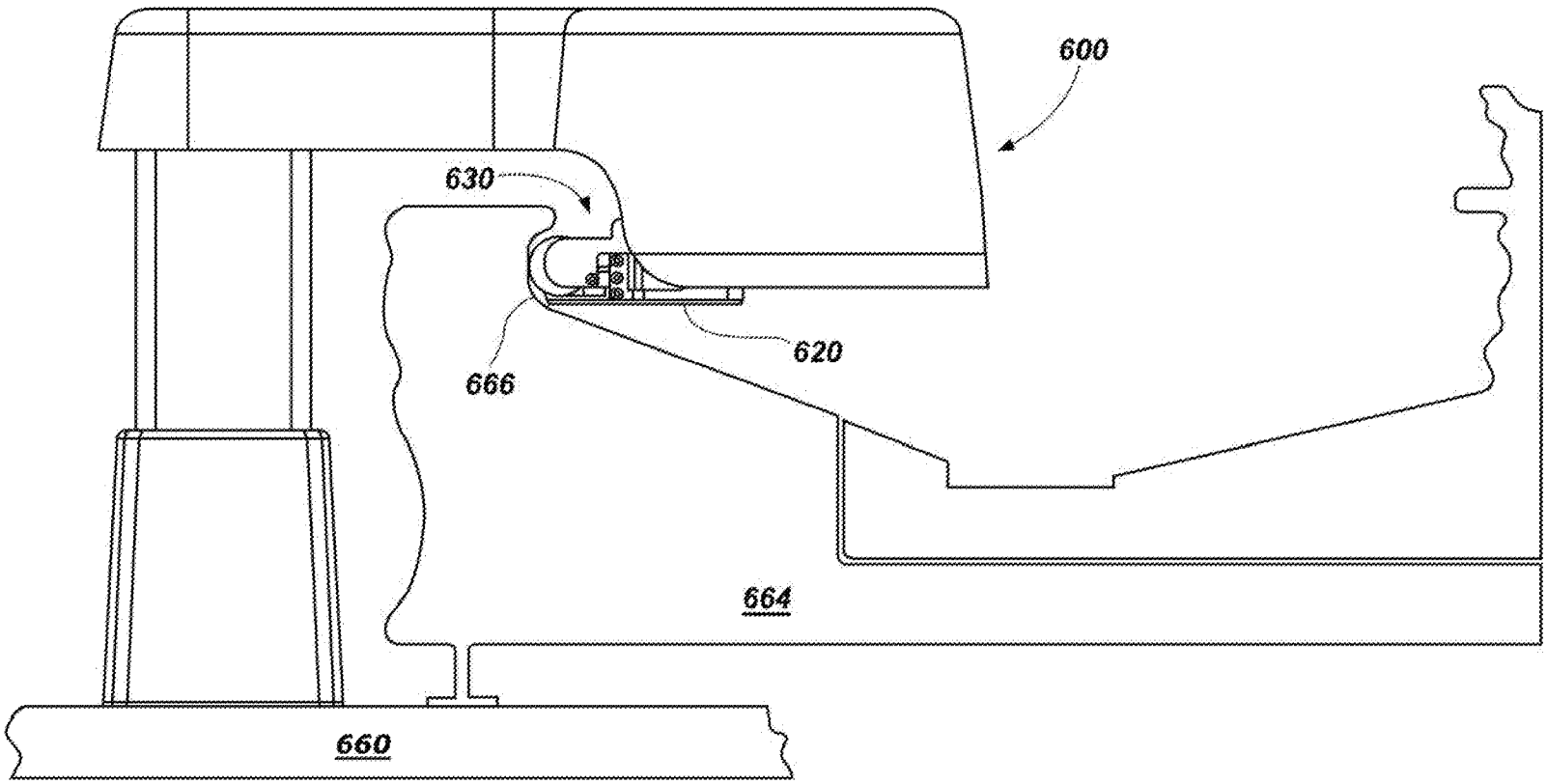
FIG. 6 is a side view of a roulette wheel with an embodiment of the invention mounted thereon.

FIG. 6 shows an embodiment of a ball launching system 600 positioned on a roulette table (possibly similar to the table 100 or the multi-player table 300 in FIG. 1 or 3, respectively). As shown, the ball launching system 600 is mounted to the table surface proximal to a roulette wheel bowl 664. The ball launching system 600 is adjusted so that a ball cup assembly 630 can rotate to a position proximal to a ball track 666. The ball cup assembly 630 may have a retain mode during which the roulette ball is captured between a first cup wall and a second cup wall and a release mode during which at least one of the first cup wall and the second cup wall moves to release the roulette ball from the ball cup assembly 630 into the ball track 666. It is understood that the first and second cup walls may move horizontally, vertically, and combinations thereof when moving with respect to each other. In some instances, the first and second cup walls may be considered leading and trailing cup walls, with the leading and trailing designations being defined with respect to a direction of rotation of a rotor 620.

In one embodiment, the ball cup assembly may be configured to receive a roulette ball when the rotor is at a loading (or HOME) position. The rotor may rotate from the loading position to a launch position with the ball cup assembly in the retain mode. When the rotor reaches the launch position, a launch actuator may cause the ball cup assembly to switch from the retain mode to the release mode and release the roulette ball into the ball track. In an embodiment, the ball cup assembly may include a rest mode in which the first and second cup watts are spaced apart further than the diameter of the roulette ball. In such an embodiment, the ball cup assembly may switch from the rest mode to the retain mode after the rotor begins to rotate.

An embodiment of the invention includes a driver that is configured to produce and impart rotary motion. Common examples of drivers are electric motors of different types and fluid-driven or electrically powered rotary actuators, some of which may convert linear motion into the needed rotary motion. Electric motors may include stepper motors, servo motors, synchronous, asynchronous, direct current and alternating current motors.

The ball launching system may further include a rotor, such as the rotor 620, which is driven in rotation by the driver. The rotor may be connected to a rotor shaft that is, in turn, driven by the driver. Alternatively, the rotor and rotor shaft may be a single integral component.

A ball launching system may have a ball cup assembly, such as the ball cup assembly 630, which is mounted to the rotor such that the roulette ball to be launched is rotated with the rotor at a position offset from the rotor axis and launched tangentially from the ball cup assembly into the ball track.

Figure 7:
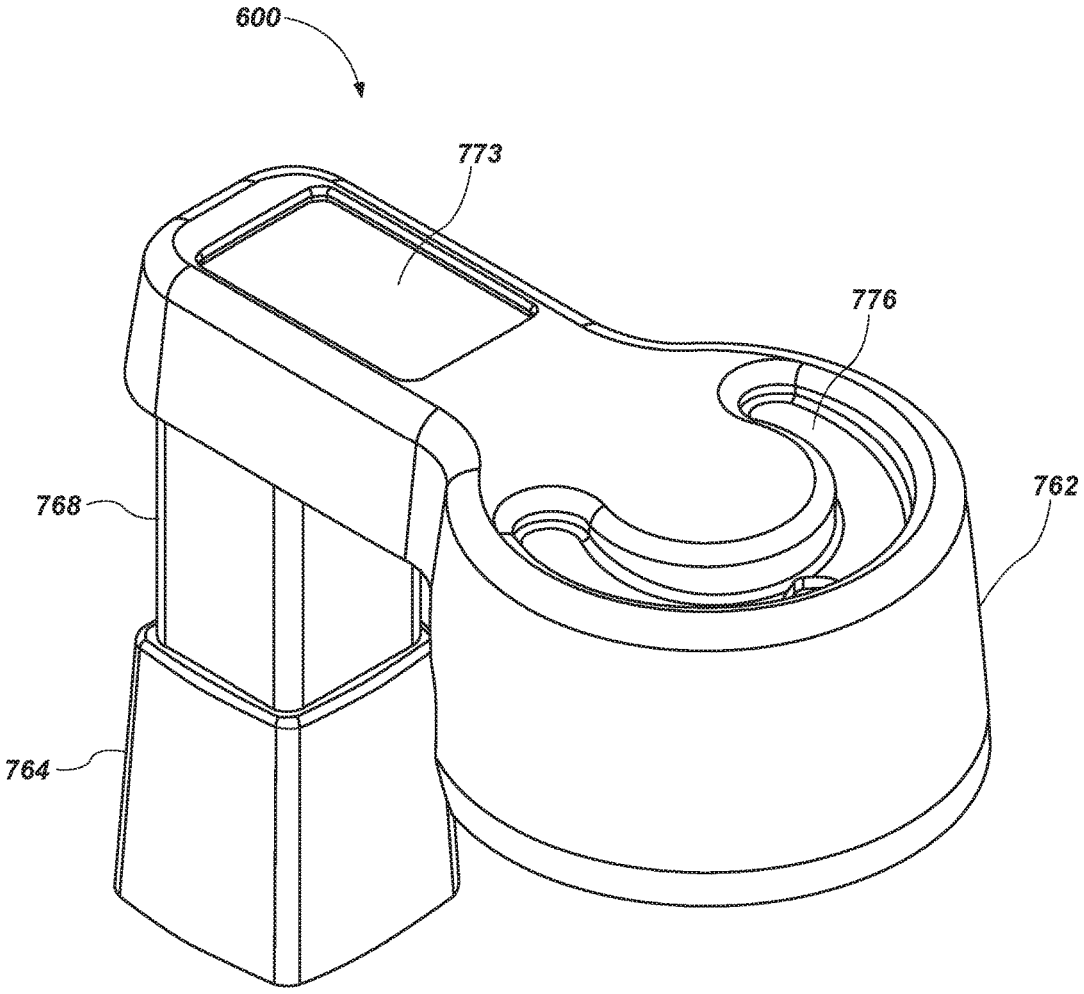
FIG. 7 is a perspective view of an embodiment of the invention.

An exemplary ball launching system 600 is shown in FIG. 7. When installed, the ball launching system 600 may comprise a top cover 762, a support post 768 and a base cover 764. The top cover may include a ball feeder 776 for holding additional roulette balls preparatory for loading into the ball launching system 600. Some embodiments may include an electronic display 773 for displaying launch system settings, game statistics, and game play information or non-game information.

Figure 8:
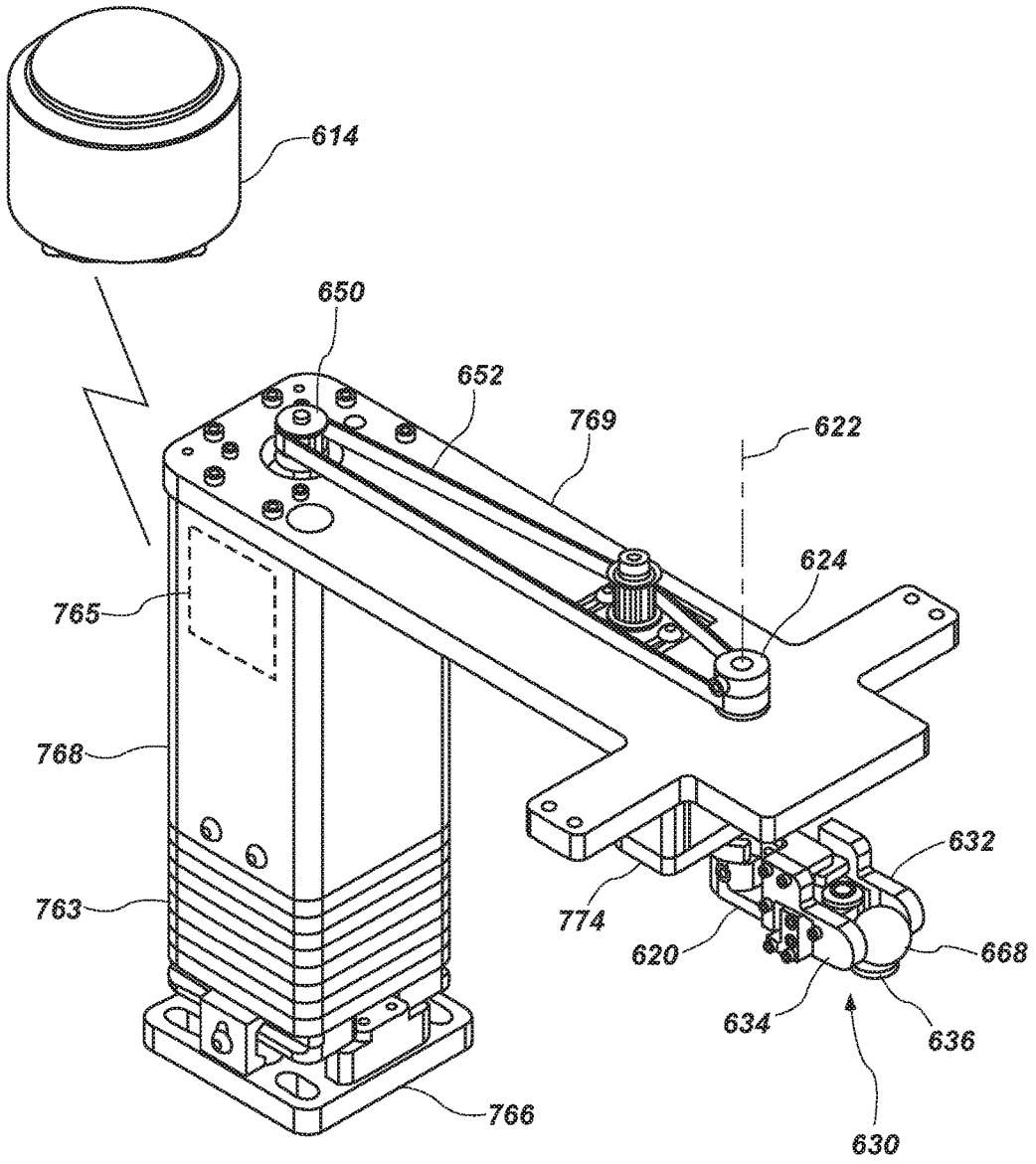
FIG. 8 is a perspective view of an embodiment of the invention with protective covers removed.

FIG. 8 shows a ball launching system similar to the ball launching system 600 with exterior covers removed. As shown in FIG. 8, a ball cup assembly 630 is mounted to the rotor 620. The ball cup assembly 630 includes a first cup wall 632 and a second cup wall 634 spaced apart from each other above a cup floor 636. The cup floor 636 may support and position a roulette ball 668 prior to launch. The cup floor 636 is fixed to and moves with the rotor 620; however, in another embodiment, the cup floor may be separate from the rotor and may be fixed in place with respect to the rotating elements of the ball cup assembly, or may be eliminated altogether.

With the roulette ball 668 loaded into the ball cup assembly 630, one, the other, or both of the first and second cup walls may move to capture and grip the roulette ball between the cup walls, and hold the ball in place prior to launch. In one embodiment, the first cup wall 632 may pivot towards the second cup wall 634 to capture the roulette ball 668 between the cup walls. In another embodiment either of the cup walls may move linearly towards and/or away from the other to facilitate gripping/releasing the roulette ball. Alternatively, various other movements of the cup walls and combinations thereof may be employed to grip and/or release the roulette ball. When captured between the cup walls, the roulette ball 668 may lift off the cup floor 636 and be fully supported by the cup walls. The cup walls may be contoured to facilitate capturing or releasing the roulette ball. The ball may be loaded individually by a croupier in preparation for launching into the roulette bowl. Alternatively, the ball launching system may include an automatic loader with multi-ball capacity that sequentially positions single balls into the ball cup.

Once loaded with a roulette ball, the ball launching system launches the ball into the roulette bowl by rotating the rotor with the ball captured in the ball cup assembly and releasing the ball at a point during the rotor's rotation. This point may be called the "launch angle." Optimally, the rotor rotates in a plane defined by a perimeter of the ball track, although some deviation from the optimal rotation may be accommodated. In some embodiments, this limitation will result in a rotor axis being positioned substantially perpendicular to the plane defined by the ball track perimeter. Here and throughout, the modifying term "substantially" and other similar terms can be interpreted to mean "within readily recognized tolerances dependent on manufacturing methods, material consistency, assembly accuracy, and other minor deviations." After launching, the rotor may rotate further to a home position in which the cup walls, cup floor, and other outermost components of the ball cup assembly are clear of the ball track. The ball launching system may be anchored to a support surface (e.g., the gaming surface 102, 302) with a fixed base 766. In an embodiment, a post 768 is connected to the fixed base 766 and may be adjusted to a preferred height by stacking spacers 763 on the fixed base 766. Various other height adjustment means, methods and combinations thereof are envisioned by the invention and are considered within the spirit and scope of the invention. In an embodiment, a beam 769 extends outward from the post 768 so that the ball cup assembly 630 can be positioned inside the roulette wheel bowl. A static shelf 774 fixed below the beam 769 is provided for convenient mounting of some components of the ball launching system. Alternatively, the ball cup assembly 630 may be supported by a unitary support stand comprising a base, post, and beam.

A driver 650 may be embedded within the post 768 and connected to a rotor shaft 624 via a drive belt 652. The drive belt 652 is configured to transmit rotary motion from the driver 650 to the rotor shaft 624 and cause the rotor 620 to rotate the ball cup assembly 630. In another embodiment, a driver may be mounted on top of the beam so that the axis of rotation of the driver is coaxially aligned with a rotor axis 622 of the rotor shaft 624. Various other configurations of a driver and the rotating components of the ball launching system are readily envisioned and remain within the spirit and scope of the invention. For example, the driver may be connected to the rotor by a chain or gear train and still be within the scope of the invention.

The ball launching system may incorporate a communication interface(s) to facilitate transmitting and/or receiving signals related to system operations. For example, the system may include electronic circuitry 765 such as a wireless communications interface that receives signals from a remote signal button 614 to initiate a roulette ball launch. Wireless communication protocols such as Bluetooth™ and others may be utilized for wireless communication. Various other wireless and wired remote signal initiators may be employed to initiate a ball launch. Additionally, a manual launch initiator, such as a physical switch or a touchscreen button may be provided proximal to the ball launching system.

Figure 9:
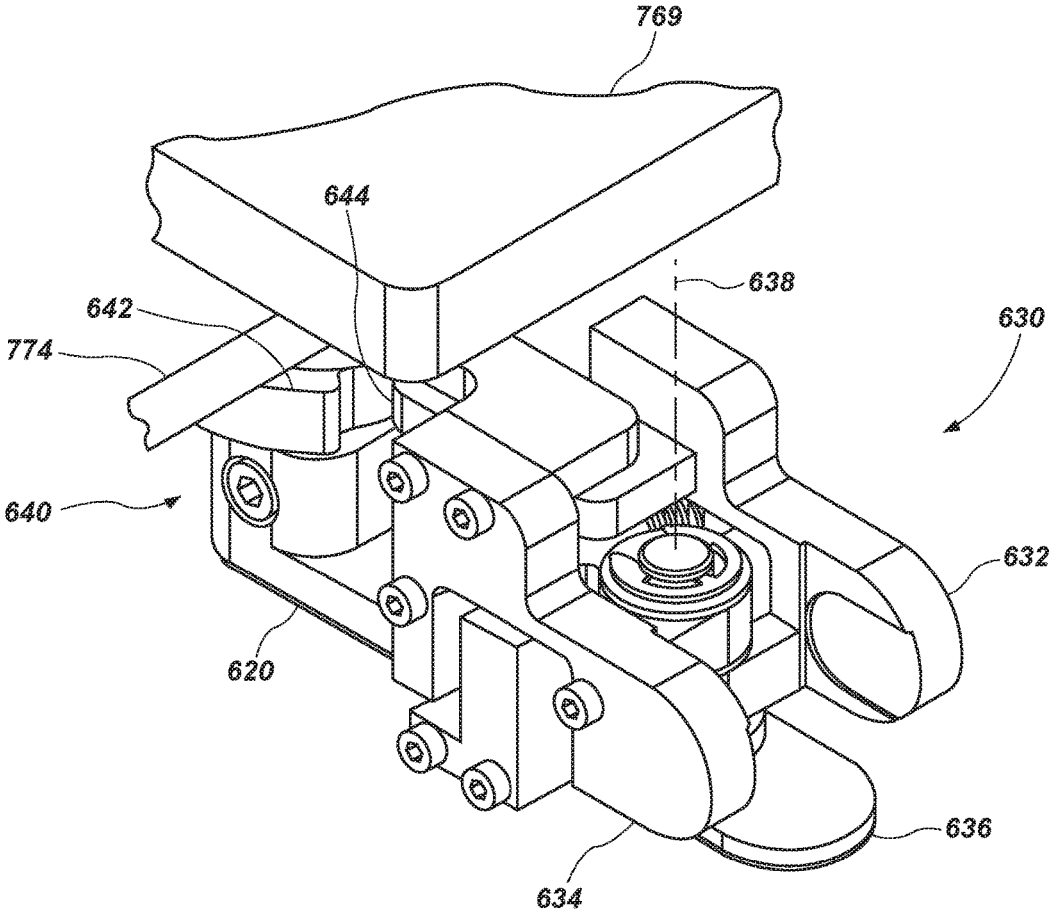
FIG. 9 is a perspective detail view of a ball cup assembly and rotor of an embodiment of the invention.

FIG. 9 is a detail view of an embodiment of a ball cup assembly 630 mounted to the rotor 620 and illustrates various components of the ball cup assembly 630. In this embodiment, first cup wall 632 and second cup wall 634 are configured to pivot around a common pivot axis 638 when moving to grip a roulette ball or to release a roulette ball. For example, the first and second cup walls 632, 634 may counter-rotate about the pivot axis to grip and/or release the roulette ball. The cup floor 636 is fixed to the rotor 620 below the cup walls 632, 634. In an embodiment, the cup walls may be adapted or replaced to accommodate roulette balls with different diameters.

The first cup wall 632 and the second cup wall 634 pivot independently in response to a launch actuator, such as a launch actuator 640. In this embodiment, the launch actuator 640 comprises both static and dynamic elements that mechanically interact to track the rotation of the rotor and to cause the necessary cup wall motions facilitating, for example, gripping and releasing the roulette ball. For example, a cam follower 644*a* is connected to the first cup wall 632 and rotates with the rotor 620 around a static cam lobe 642*a* that is mounted to the shelf 774. Another cam follower 644*b* is above 644*a* and is positioned to interact with cam lobe 642*b*. When the cam follower 644*a* contacts the cam lobe 642*a*, the first cup wall 632 pivots around the pivot axis 638 as the cam follower 644*a* rides up onto the cam lobe. Depending on the direction that the rotor 620 is rotating, the cam lobe/cam follower interaction may cause the first cup wall 632 to pivot away from or towards the second cup wall 634, resulting in either gripping a roulette ball between the first and second cup walls or releasing a roulette ball from the ball cup assembly.

In an alternative embodiment, the launch actuator may comprise different components such as a positional sensor, a rotation sensor, and one or more rotary actuators to track rotational position and initiate the grip and release motions of the cup walls. Alternatively, the launch actuator components may move the cup walls linearly towards and away from each other, or utilize a combination of linear and rotary movements of the cup walls. Also, a launch actuator may comprise a combination of mechanical, electronic, and various other components to facilitate grip and release at appropriate points during rotation. These and other variants are considered to be within the scope of this disclosure.

Figure 10A:
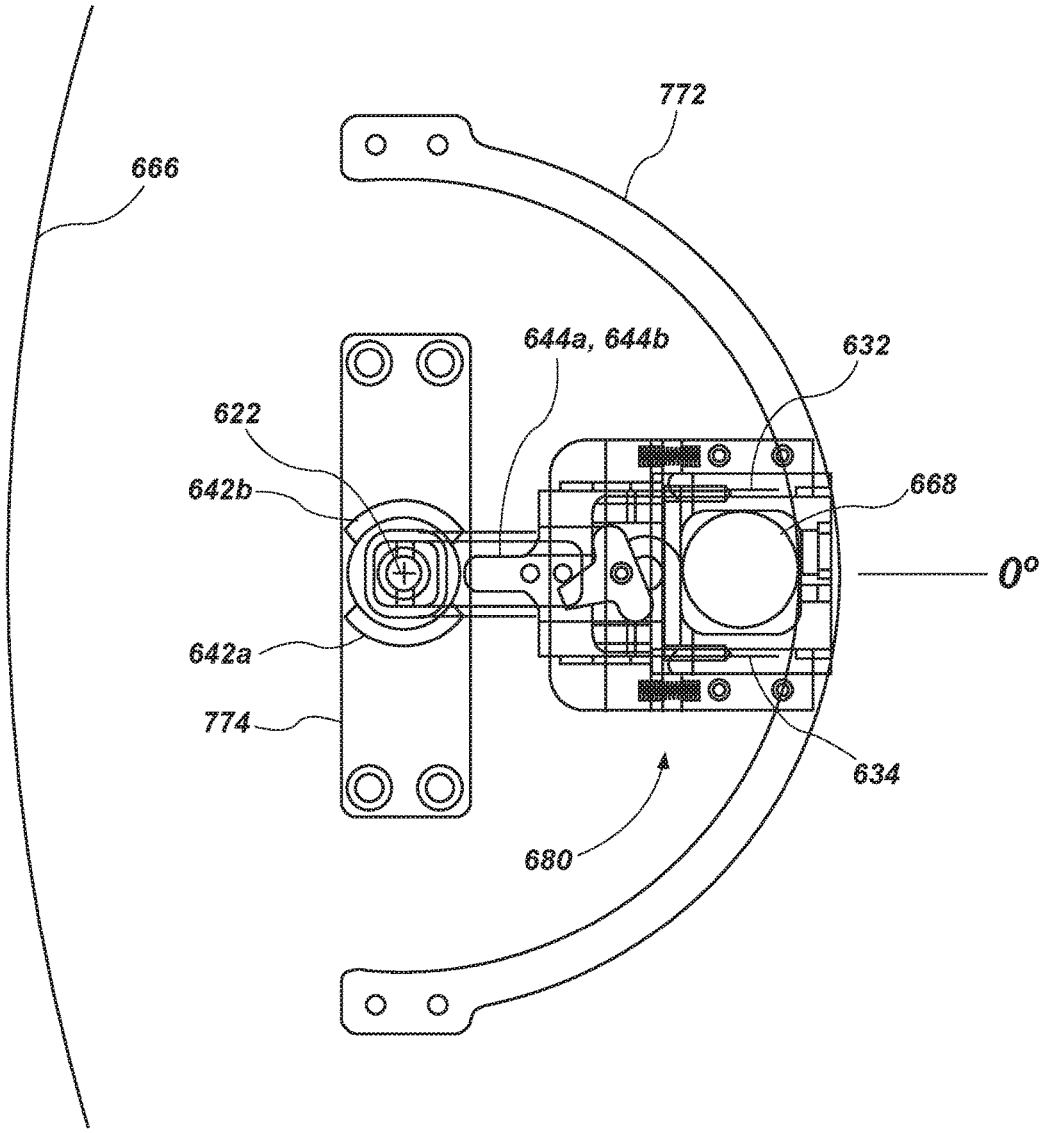
FIGS. 10A through 10F are top views of an embodiment of the invention with the rotor at different rotation angles.
Figure 10B:
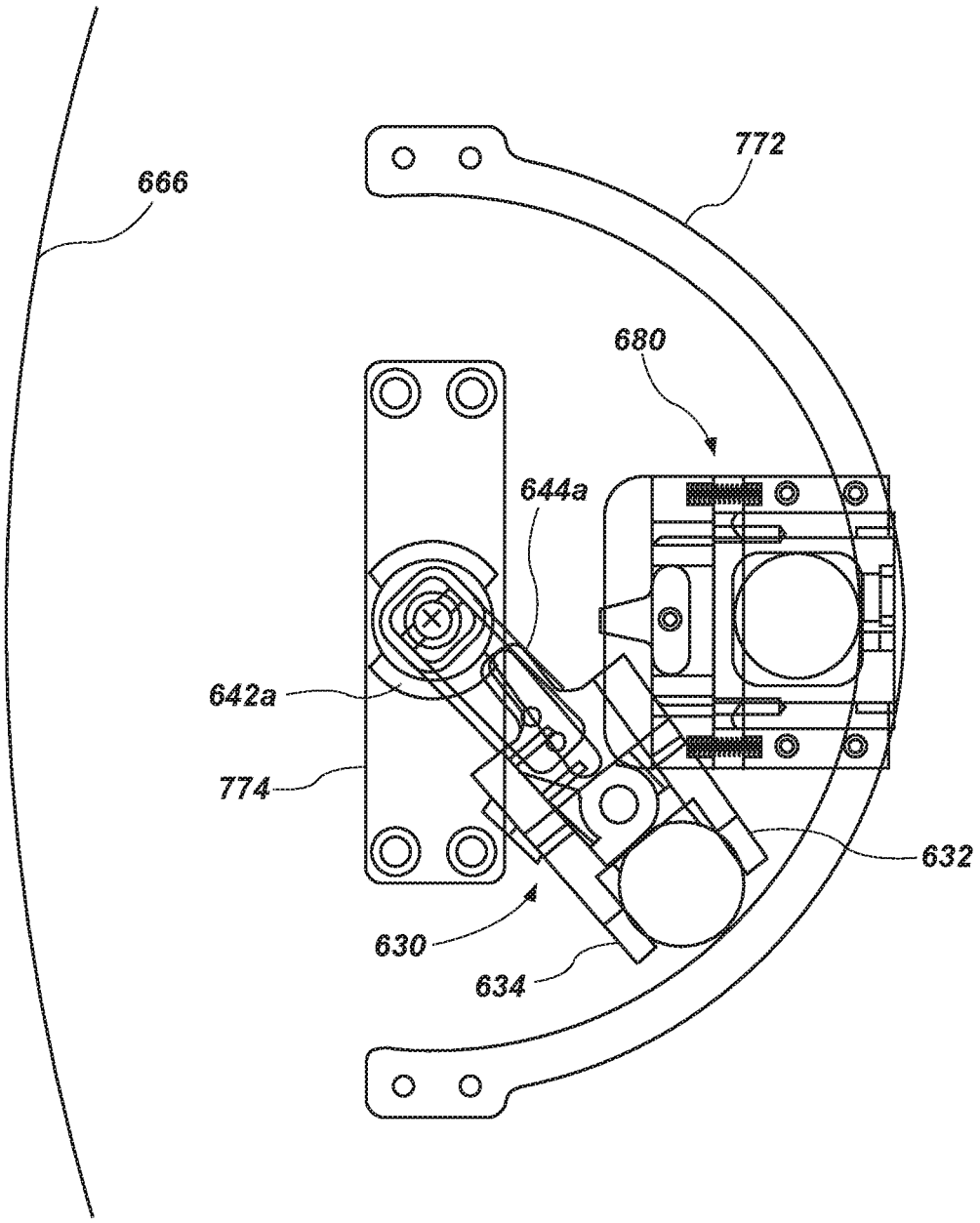
Figure 10C:
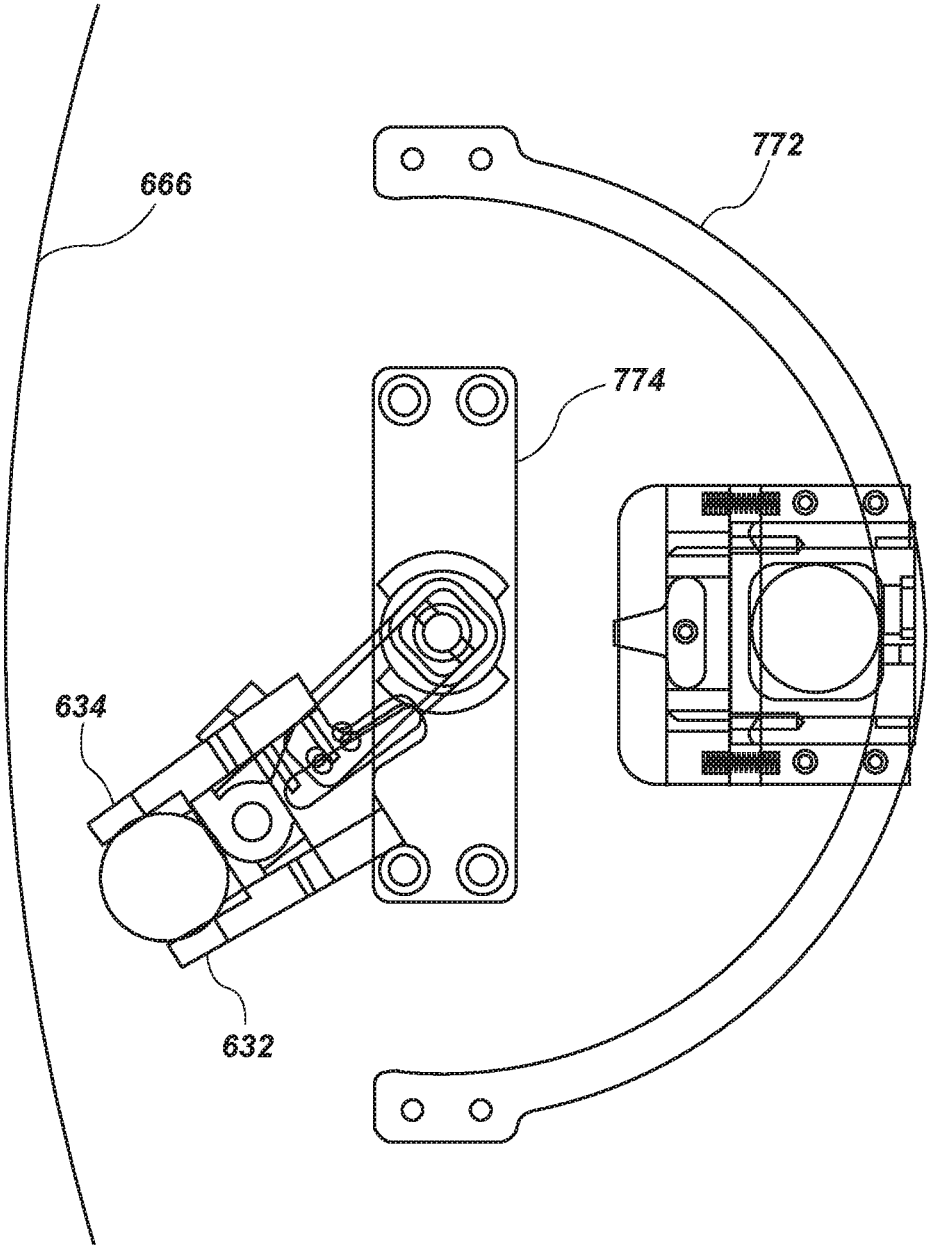
Figure 10D:
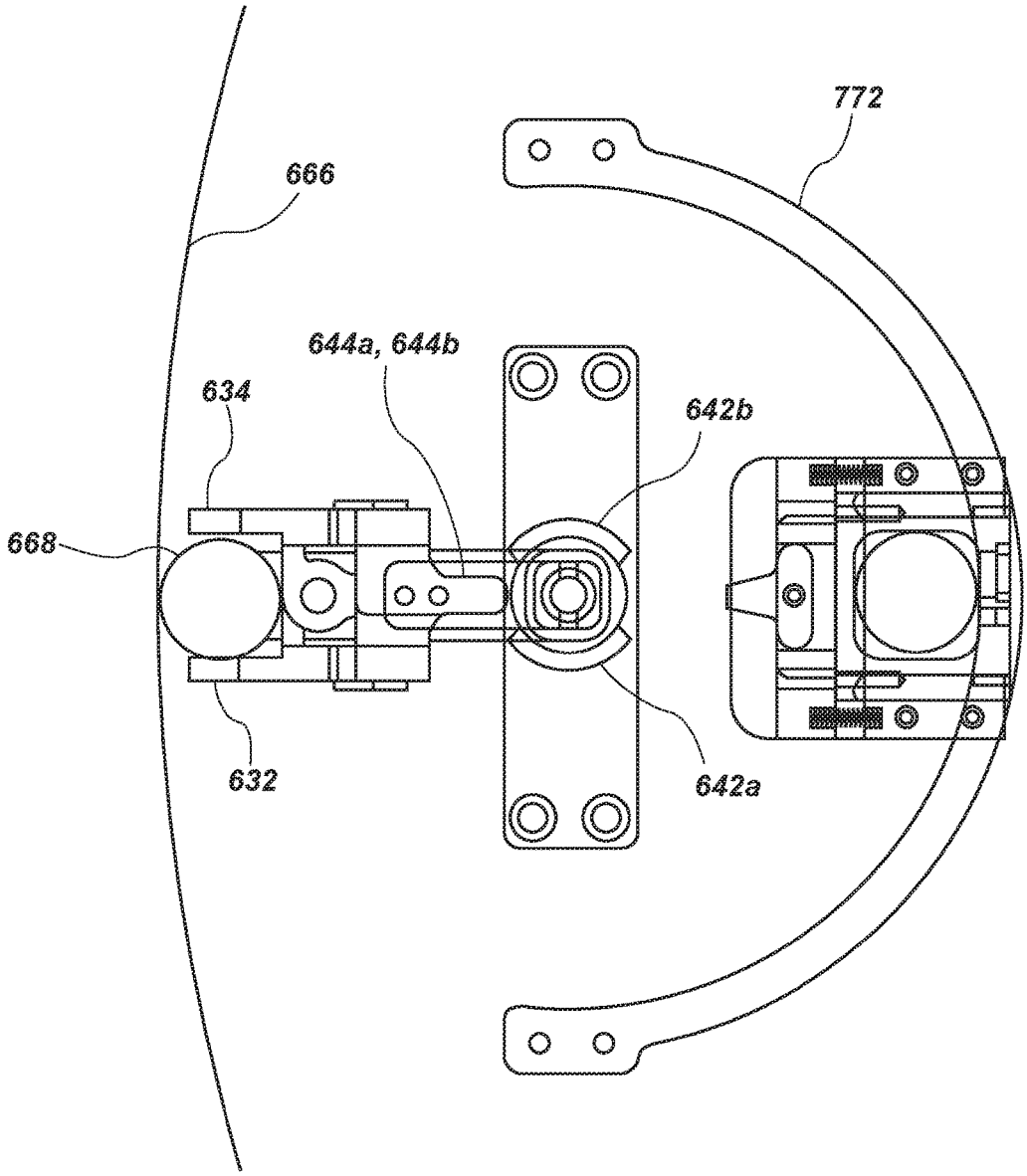
Figure 10E:
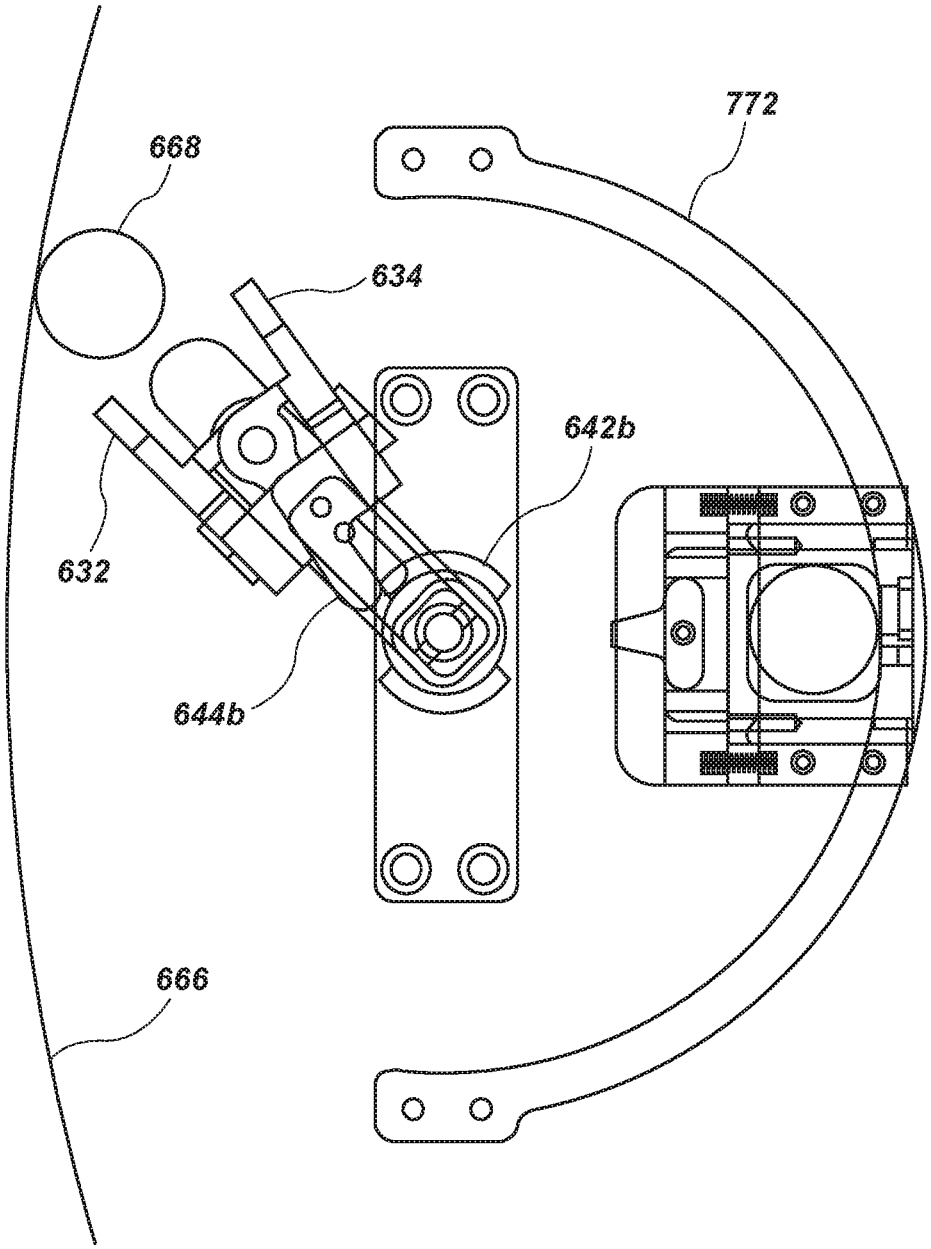
Figure 10F:
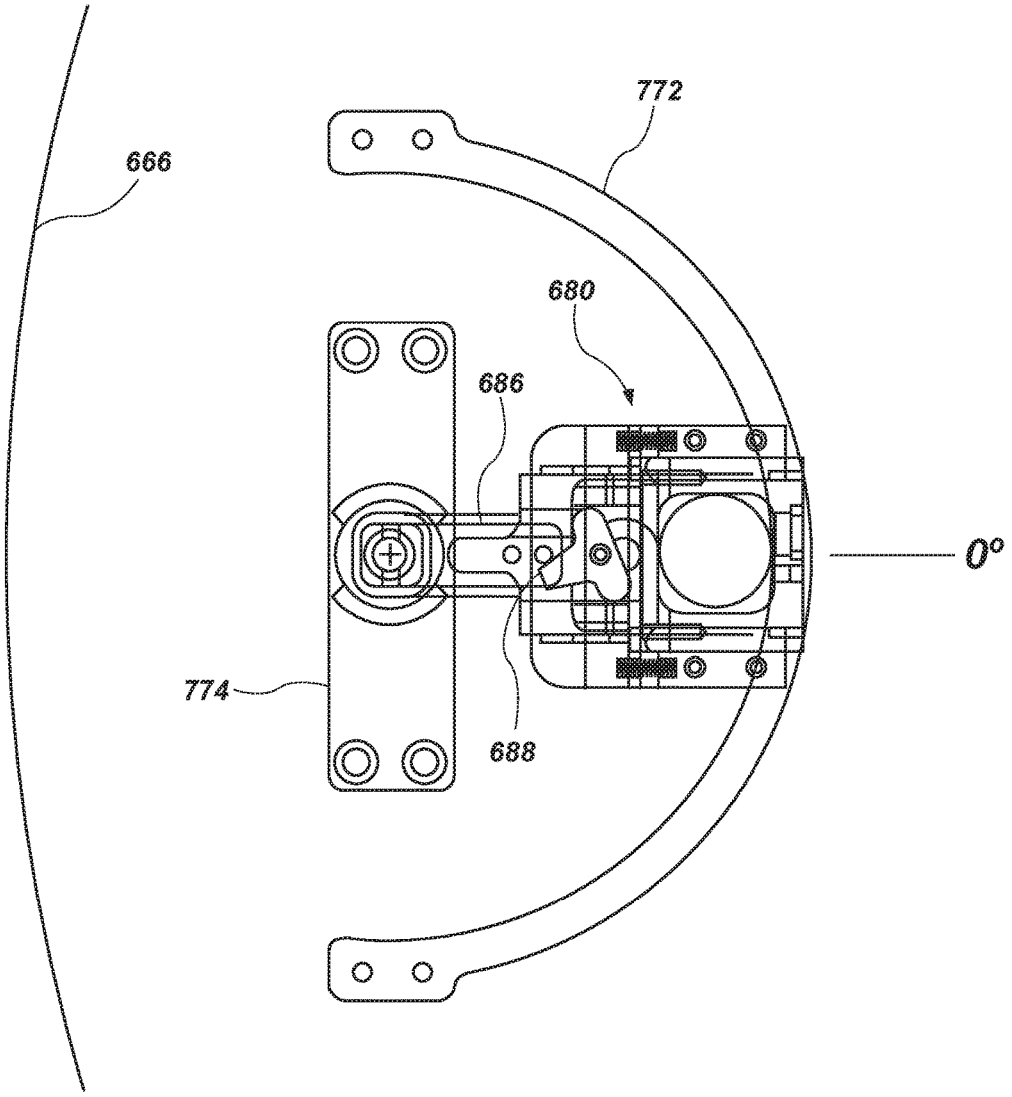

The actions of the ball launching system 600 are illustrated in FIGS. 10 through 10F. In FIG. 10A, the top view shows the rotor positioned at a HOME position, which is designated 0° in this series of figures. All angular measurements depicted in the figures are approximate and are provided for example only. They do not define specific angular positions for other embodiments of the invention.

At 0°, the first and second cup walls 632, 634 are substantially parallel to each other with a roulette ball resting on the cup floor 636 (not shown) between the cup walls. Aspects of the ball cup assembly at the HOME position are obscured by an automatic ball loader 680 which is mounted above the rotor. The ball loader 680 will be discussed in detail later in this disclosure.

Also visible in FIG. 10A is a shield 772 which, in some embodiments, is present to prevent the roulette ball from falling out of the ball cup assembly while the cup walls are parallel to each other. A portion of a ball track 666 is shown for positional reference. Also shown in FIG. 10A are the cam lobes 642 mounted to the shelf 774, and the rotor axis 622.

In FIG. 10B, the rotor has rotated approximately 45° around the rotor axis 622 (FIG. 10A) from the HOME position. The cam follower 644*a* has contacted a cam lobe 642*a* causing the cam follower 644*a* and the first cup wall 632 to rotate around the pivot axis 638. The roulette ball 668 is gripped between the first cup wall 632 and the second cup wall 634. The other cam follower 644*b*, positioned above cam follower 644*a*, passes above cam lobe 642*a* without making contact.

FIG. 10C shows the rotor 620 (FIG. 9) at approximately 135°. The ball cup assembly 630 (FIG. 10B) is no longer in close proximity to the shield 772, and the roulette ball 668 is captured between the first and second cup walls 632, 634. In some embodiments, the driver may stop the rotor 620 at or near this position until the ball launching system receives a signal from a launch button or other launch initiator indicative of a command to release the roulette ball into the ball track.

FIG. 10D shows the rotor 620 (FIG. 9) at approximately 180°. In this embodiment, the cam follower 644*a* has passed the cam lobe 642*a*, and both the first and second cup walls 632, 634 are parallel to each other with the roulette ball between them. The roulette ball 668 may actually contact the ball track 666 at this point but is still contained within the ball cup assembly.

In FIG. 10E, the rotor 620 (FIG. 9) has rotated to approximately 225°. The roulette ball 668 is moving into the ball track 666 and the cam follower 644*b* has contacted the cam lobe 642*b* causing the second cup wall 634 to pivot away from the first cup wall 632. As the rotor continues to rotate past 225°, the cam follower 644*b* may ride up the cam lobe 642*b* and pivot the second cup wall 634 further from the first cup wall 632.

The ball launching system may be capable of launching a roulette ball onto the ball track in either angular direction (e.g., clockwise and counterclockwise). The launch direction may be selected by a player, selected by a croupier prior to launch, and may be selected randomly, alternately, or in a programmed pattern. The ball launching system may employ internal memory and/or external memory to store instructions that determine launch direction, launch speed, launch delays for multiple balls, and other launch characteristics. To prevent predictive behavior, launch characteristics (e.g., launch speed) may be varied randomly or intermittently with each successive ball. For example, the electronic circuitry 765 (shown in FIG. 8) may include controllers and/or memory devices configured to control various operations and functions of the ball launching system. Information regarding launch characteristics may be hidden from a player or may be selectively displayed to a player and/or a croupier via, for example, the electronic display 773 (FIG. 7), the display 130 (FIG. 1), and the display 310 (FIG. 3).

In FIG. 10F, the rotor 620 (FIG. 9) has returned to the HOME position at 0°. The ball cup assembly 630 is again positioned to accept another roulette ball from the ball loader 680.

The ball launching system may include provisions for storing and automatically loading a plurality of roulette balls. Automatic loading enables the launching system to launch multiple balls in succession into the ball track. For example, a player may elect to play two or three balls on each spin. The player may wager accordingly, and the awards for a successful prediction may be augmented for a multi-ball spin.

Figure 11:
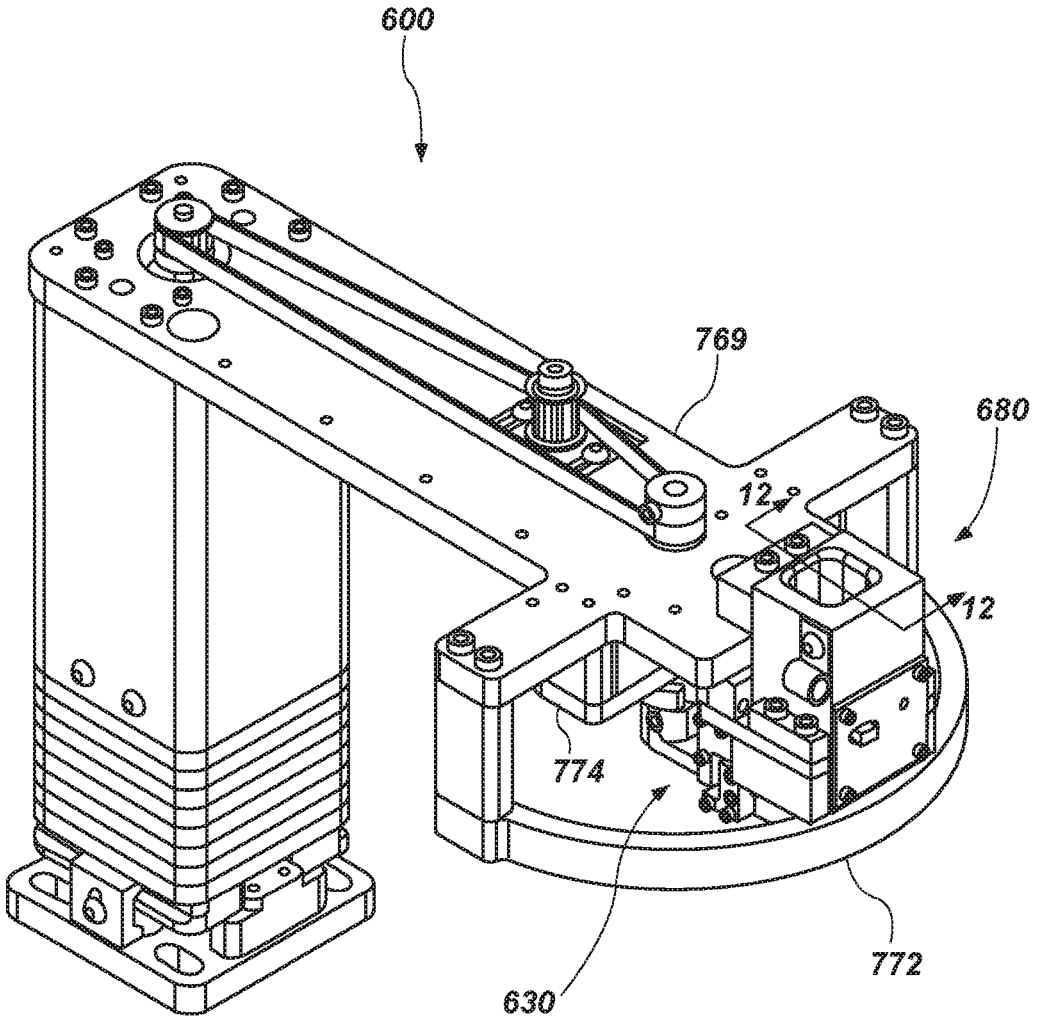
FIG. 11 is a perspective detail view of an embodiment of the invention including a roulette ball loader mounted thereon.

As shown in FIG. 11, the ball launching system 600 may include a ball loader 680. The loader 680 is mounted to the beam 769 above the ball cup assembly 630. The loader 680 in FIG. 11 is positioned to correspond with the 0° rotor position depicted in FIG. 10A. (i.e., the HOME or loading position). The loader 680 is further positioned to receive balls from the ball feeder 776 shown in FIG. 7.

Figure 12:
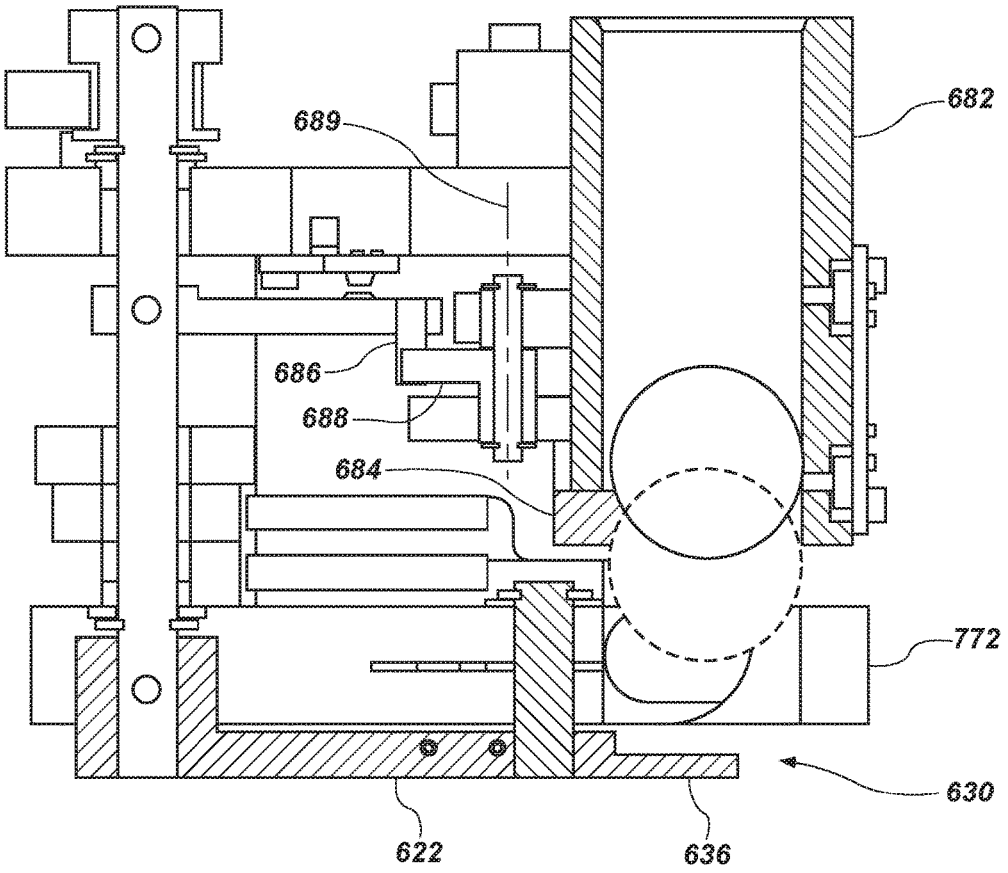
FIG. 12 is a cross-sectional view across section line 12-12 (of FIG. 11) of a roulette ball loader.

FIG. 12 is a section view across section line 12-12 (of FIG. 11) of the ball loader 680 in position above the rotor 620 and ball cup assembly 630. The loader 680 includes a magazine 682 for holding a plurality of roulette balls prior to loading in the ball cup assembly 630. In the embodiment shown, the magazine is a vertical storage region in which additional roulette balls may stack on top of each other. At the bottom of the magazine 682 is a latch 684 that has an open and closed position. In the closed position (shown in solid lines) the latch 684 protrudes into the magazine 682 to block the bottommost ball in the magazine from dropping into the ball cup assembly 630. When the ball cup assembly 630 is ready to receive a roulette ball, the latch 684 moves to the open position (shown in dashed lines) to permit the bottommost ball to drop into the ball cup assembly 630.

The loader latch may be controlled by various actuating components. The latch 684 is moved from the closed to the open position in response to interactions between a loader arm 686 (also shown in FIG. 10F) that rotates with the rotor shaft 624 (FIG. 8). In this embodiment, as the rotor moves to the HOME position, the loader arm contacts a loader lever 688 (also shown in FIG. 10F), causing the loader lever 688 to pivot about a lever axis 689 and move the latch 684 between the open and closed positions. Alternatively, the latch 684 may be biased to the closed position by a resilient component such as a spring, and the lever 688 may deflect the resilient component to move the latch 684 to the open position. Various other means and methods may be employed to automatically load roulettes balls into the ball cup assembly and would still be considered to be within the bounds of the invention disclosed herein.

The various embodiments and examples described herein are provided by way of illustration only and should not be construed to limit the claimed invention, nor the scope of the various embodiments and examples. Those skilled in the art will readily recognize various modifications and changes that may be made to the claimed invention without following the example embodiments and applications illustrated and described herein and without departing from the true spirit and scope of the claimed invention, which is set forth in the following claims. In addition, various embodiments may be combined. Therefore, reference to an embodiment, one embodiment, in some embodiments, in other embodiments, and the like does not preclude one or more methods, functions, steps, features, results, hardware implementations, or software implementations of different embodiments from being combined. Further, reference to an embodiment, one embodiment, in some embodiments, in other embodiments, examples, and the like provides various aspects that may or may not be combined with those of one or more different embodiments and/or examples.

While the example embodiments have been described with relation to a gaming environment, it will be appreciated that the above concepts can also be used in various non-gaming environments. For example, such rewards can be used in conjunction with purchasing products, e.g., gasoline or groceries, associated with vending machines, used with mobile devices or any other form of electronic communications. Accordingly, the disclosure should not be limited strictly to gaming casinos, arcades, portal based game sites, cellular phone devices, personal digital assistant devices, laptops, personal computers, home game consoles, bar top gaming devices, table gaming devices, surface computing devices, table gaming biometric touch screens, television gaming, or in-room gaming devices.

The foregoing description, for purposes of explanation, uses specific nomenclature and formula to provide a thorough understanding of the disclosed embodiments. It should be apparent to those of skill in the art that the specific details are not required in order to practice the disclosed embodiments. The embodiments have been chosen and described to best explain the principles of the invention and its practical application, thereby enabling others of skill in the art to utilize the invention, and various embodiments with various modifications as are suited to the particular use contemplated. Thus, the foregoing disclosure is not intended to be exhaustive or to limit the invention to the precise forms disclosed, and those of skill in the art recognize that many modifications and variations are possible in view of the above teachings.

What is claimed is:

1. A roulette ball launching system including a roulette table comprising a roulette wheel having a roulette wheel bowl with a circumferential ball track proximate and inside of the roulette wheel bowl, the roulette ball launching system also including a ball launching device, the ball launching device, comprising:

a beam extending from a proximal end to a distal end;

a rotor shaft connected to the beam proximate the distal end of the beam, the rotor shaft defining a rotor axis below the distal end of the beam;

a driver operatively connected to the rotor shaft and configured to impart rotary motion about the rotor axis defined by the rotor shaft, the rotary motion being in a horizontal plane;

a rotor extending from the rotor shaft and operatively connected to the driver for rotation about the rotor axis;

a ball cup assembly mounted to the rotor and under the distal end of the beam, the ball cup assembly comprising a first cup wall, and a second cup wall, the first and second cup walls being spaced apart from each other; and the beam being positionable over the roulette wheel bowl to position the rotor and the ball cup assembly inside the roulette wheel bowl proximal the circumferential ball track, a perimeter of the circumferential ball track defining the horizontal plane, wherein the driver is configured to rotate the rotor through the horizontal plane, about the rotor axis, below the distal end of the beam, to a launch angle with a roulette ball captured between the first and second cup walls, and wherein a launch actuator is configured to cause at least one of the first and second cup walls to move away from the other cup wall to release the roulette ball from the ball cup assembly into the circumferential ball track when the rotor is at the launch angle.

2. The roulette ball launching system of claim 1, wherein the rotor axis is substantially perpendicular to the horizontal plane defined by the perimeter of the circumferential ball track.

3. The roulette ball launching system of claim 1, wherein the driver rotates the rotor at one of a plurality of randomly determined rotational speeds to vary a launch speed of the roulette ball.

4. The roulette ball launching system of claim 1, wherein the driver rotates the rotor at one of a plurality of selectable rotational speeds to vary a launch speed of the roulette ball.

5. The roulette ball launching system of claim 1, wherein the first and second cup walls move away from each other by counter-rotating about a common pivot axis.

6. The roulette ball launching system of claim 1, wherein:

the launch actuator comprises one or more cams and one or more cam followers, and wherein the launch actuator is configured such that interaction between the one or more cams and the one or more cam followers causes the at least one of the first and second cup walls to move away from the other cup wall.

7. The roulette ball launching system of claim 1, wherein the driver is offset from the rotor axis of rotation and is operatively connected to the rotor shaft by at least one of a belt, chain, or gear train.

8. The roulette ball launching system of claim 1, wherein the driver is axially aligned with the rotor axis of rotation and drives the rotor shaft directly.

9. The roulette ball launching system of claim 1, wherein the ball cup assembly further comprises a cup floor configured to support the roulette ball between the first and second cup walls.

10. The roulette ball launching system of claim 1, further comprising:

a ball loader configured to deliver the roulette ball to the ball cup assembly when the rotor is positioned at a loading angle, wherein the launch actuator is configured to cause the ball cup assembly to switch from a retain mode, during which the roulette ball is captured between at least the first cup wall and the second cup wall, to a launch mode to release the roulette ball into the circumferential ball track when the rotor is at the launch angle.

11. The roulette ball launching system of claim 10, wherein the ball cup assembly further has a rest mode in which the first cup wall and the second cup wall are spaced apart further than the diameter of the roulette ball, wherein the ball cup assembly is configured to switch from the rest mode to the retain mode after the rotor starts to rotate.

12. The roulette ball launching system of claim 10, wherein the launch actuator is configured to cause the ball cup assembly to switch modes in response to an electronic signal from a rotation sensor.

13. The roulette ball launching system of claim 10, wherein the driver comprises a motor configured to drive the rotor shaft directly.

14. The roulette ball launching system of claim 10, wherein the driver comprises a drive motor offset from the rotor axis, the drive motor configured to drive the rotation of the rotor via a belt, a chain, or one or more gears.

15. The roulette ball launching system of claim 10, wherein the rotor and the ball cup assembly are rotatable in an angular direction through the horizontal plane to release the roulette ball in a first direction, and are also rotatable in an opposite angular direction to release the roulette ball in a second direction.

16. The roulette ball launching system of claim 10, wherein the launch actuator comprises at least one cam and at least one cam follower, and wherein the launch actuator is configured to switch modes in response to interaction between the at least one cam and the at least one cam follower.

17. The roulette ball launching system of claim 10, wherein the launch actuator comprises at least one sensor connected to electronic circuitry, and wherein the launch actuator is configured to switch the ball launching system from at least one mode to another mode in response to receiving an electronic signal from the at least one sensor via the electronic circuitry.

18. A method of conducting a roulette game with the roulette ball launching system of claim 1, the method comprising:

providing the roulette ball launching system of claim 1;

spinning the roulette wheel;

receiving a player input at a signal button to activate the ball launching device;

in response to receiving a signal from the signal button, rotating, via the driver, the rotor about the rotor axis and through the horizontal plane to the launch angle; and in response to the rotor being at the launch angle, trigger a launch of the roulette ball captured between first and second cup walls of the ball cup assembly, wherein triggering the launch causes at least one of the first and second cup walls to move away from the other cup wall to release the roulette ball from the ball cup assembly into the circumferential ball track.

19. The method of claim 18, further comprising, prior to rotating the rotor through the horizontal plane to the launch angle:

rotating the rotor to a pre-launch angle; and at the pre-launch angle, moving one of the first and second cup walls toward the other of the first and second cup walls to grip the roulette ball.

20. The method of claim 19, wherein moving one of the first and second cup walls toward the other of the first and second cup walls comprises moving a leading cup wall of the first and second cup walls toward a trailing cup wall of the first and second cup walls, the leading and trailing cup walls being defined with respect to a direction of rotation of the rotor.

* * * * *